US008342142B2

(12) United States Patent
Shintani et al.

(10) Patent No.: US 8,342,142 B2
(45) Date of Patent: Jan. 1, 2013

(54) COOLING APPARATUS AND COOLING METHOD FOR INTERNAL COMBUSTION ENGINE

(75) Inventors: Osamu Shintani, Toyota (JP); Shinichi Hamada, Anjo (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 796 days.

(21) Appl. No.: 12/449,470

(22) PCT Filed: Feb. 26, 2008

(86) PCT No.: PCT/IB2008/000418

§ 371 (c)(1), (2), (4) Date: Aug. 10, 2009

(87) PCT Pub. No.: WO2008/104855

PCT Pub. Date: Sep. 4, 2008

(65) Prior Publication Data

US 2010/0083916 A1 Apr. 8, 2010

(30) Foreign Application Priority Data

Feb. 28, 2007 (JP) ..... 2007-049951

(51) Int. Cl.
*F01P 7/02* (2006.01)

(52) U.S. Cl. ..... 123/41.12; 123/41.44; 123/41.48

(58) Field of Classification Search ..... 123/41.1, 123/41.12, 41.44, 41.48
See application file for complete search history.

(56) References Cited

U.S. PATENT DOCUMENTS

| | | | | |
|---|---|---|---|---|
| 5,036,803 | A | 8/1991 | Nolting et al. | |
| 5,095,855 | A | 3/1992 | Fukuda et al. | |
| 5,609,125 | A * | 3/1997 | Ninomiya | 123/41.12 |
| 5,619,957 | A * | 4/1997 | Michels | 123/41.44 |
| 6,178,928 | B1 * | 1/2001 | Corriveau | 123/41.12 |
| 6,374,780 | B1 * | 4/2002 | Rutyna et al. | 123/41.12 |
| 7,267,082 | B2 * | 9/2007 | Lalor | 119/859 |
| 2004/0069546 | A1 | 4/2004 | Lou et al. | |

FOREIGN PATENT DOCUMENTS

| | | |
|---|---|---|
| JP | B2-2767995 | 6/1998 |
| JP | A-2004-27991 | 1/2004 |
| JP | A-2004-360509 | 12/2004 |
| JP | A-2006-37883 | 2/2006 |

* cited by examiner

*Primary Examiner* — Noah Kamen
*Assistant Examiner* — Hung Q Nguyen
(74) *Attorney, Agent, or Firm* — Oliff & Berridge, PLC

(57) ABSTRACT

A cooling apparatus includes an electric water pump that circulates a coolant, a radiator that radiates heat of the coolant, an electric fan that cools the radiator, a control device, and first flow rate correction means. The control device controls the discharge flow rate of the electric water pump based on a target flow rate set based on an amount of heat generated in an engine, and controls operation of the electric fan based on a coolant temperature. When the coolant temperature is equal to or higher than a fan operation temperature at which the operation of the electric fan is started, the first flow rate correction means increases the discharge flow rate of the electric water pump in accordance with an increase in the coolant temperature.

19 Claims, 16 Drawing Sheets

COOLING APPARATUS AND COOLING METHOD FOR INTERNAL COMBUSTION ENGINE

BACKGROUND OF THE INVENTION

1. Field of the Invention

The invention relates to a cooling apparatus and a cooling method for an internal combustion engine that includes an electric water pump and an electric fan.

2. Description of the Related Art

A radiator, which cools a coolant for an internal combustion engine, is provided with an electric fan that maintains or assists the cooling performance of the radiator. The electric fan is operated when the temperature of the coolant is higher than a predetermined value. The coolant is circulated between the internal combustion engine and the radiator by a water pump. The water pump is generally operated using an engine output. The flow rate of the water pump is changed in synchronization with a change in an engine speed. Therefore, when the engine speed is low, the flow rate is low.

Accordingly, for example, a cooling apparatus described in Japanese Patent No. 2767995 includes a first water pump that is operated using an engine output; and a second water pump that is operated by an electric motor. When the engine speed is low, and the flow rate of the first water pump is insufficient, the second water pump is operated to compensate for the insufficiency.

The electric water pump and the electric fan consume electric power when the electric water pump and the electric fan are operated. Therefore, unless the electric water pump and the electric fan are controlled taking into account the efficiency of cooling the coolant, for example, the electric power consumed in the vehicle may be unnecessarily increased. Such an unnecessary increase in the consumed electric power may lead to, for example, an increase in the operating load of the alternator, which adversely affects the fuel efficiency of the internal combustion engine.

SUMMARY OF THE INVENTION

The invention provides a cooling apparatus and a cooling method for an internal combustion engine, which more appropriately control operation of an electric water pump and operation of an electric fan.

Hereinafter, aspects of the invention and advantageous effects obtained in the aspects of the invention will be described. A first aspect of the invention relates to a cooling apparatus for an internal combustion engine. The cooling apparatus includes an electric water pump that circulates a coolant in a cooling pipe provided in an internal combustion engine; a radiator that radiates heat of the coolant; an electric fan that cools the radiator; a control device that controls the electric water pump and the electric fan; and first flow rate correction means. The control device controls a discharge flow rate of the electric water pump based on a target flow rate set according to an amount of heat generated in the internal combustion engine, and controls operation of the electric fan based on a temperature of the coolant. The first flow rate correction means increases the discharge flow rate in accordance with an increase in the temperature of the coolant, when the temperature of the coolant is equal to or higher than an operation temperature at which the operation of the electric fan is started.

In the above-described aspect, the target flow rate of the electric water pump is set based on the amount of heat generated in the internal combustion engine, and the discharge flow rate of the electric water pump is controlled based on the target flow rate. Thus, the discharge flow rate is adjusted according to a cooling request corresponding to the amount of heat generated in the engine.

When the amount of heat generated in the engine changes, for example, a response delay occurs in the adjustment of the coolant temperature performed through the control of the discharge flow rate, and as a result, the coolant temperature may increase. Accordingly, in the above-described aspect, in the situation where the coolant temperature increases, the discharge flow rate is increased in accordance with the increase in the coolant temperature. If the electric fan is not operated when the discharge flow rate is increased, the amount of coolant supplied to the radiator may be so large that the heat of the coolant cannot be sufficiently radiated by the radiator. In this case, the coolant may not be efficiently cooled although the electric power for operating the electric water pump is increased. Thus, in the above-described aspect, the discharge flow rate is increased when the coolant temperature is equal to or higher than the operation temperature at which the operation of the electric fan is started. Therefore, the electric fan is operated when the flow rate of the coolant supplied to the radiator is increased. Thus, the discharge flow rate Vw is increased when the level of the radiation performance of the radiator is high. Accordingly, it is possible to increase the level of the cooling performance, without wasting the increased electric power for driving the electric water pump. Thus, the operation of the electric water pump and the operation of the electric fan are appropriately controlled. Also, in the above-described aspect, the discharge flow rate is increased in accordance with the increase in the coolant temperature. Therefore, as compared to the case where the discharge flow rate is sharply increased when the coolant temperature is higher than the operation temperature at which the operation of the electric fan is started, it is possible to appropriately suppress the increase in the electric power consumed by the electric water pump.

The above-described cooling apparatus may further include second flow rate correction means for correcting the discharge flow rate of the electric water pump based on a vehicle speed.

As the speed of the vehicle increases, the amount of air passing through the radiator increases, and therefore, the level of the radiation performance of the radiator increases. Accordingly, in the above-described cooling apparatus, the discharge flow rate of the electric water pump is corrected based on the vehicle speed. Thus, the discharge flow rate of the electric water pump is changed according to the level of the radiation performance of the radiator that is changed according to the vehicle speed. This increases the cooling efficiency. Accordingly, it is possible to increase the level of the cooling performance, while effectively using the electric power supplied to the electric water pump.

Also, because the increase in the coolant temperature is suppressed by increasing the level of the cooling performance in the above-described manner, it is possible to reduce the possibility that the electric fan is operated due to the increase in the coolant temperature, when the electric fan is not operated. This reduces the frequency of operating the electric fan. Therefore, it is possible to suppress the increase in the electric power consumed by operating the electric fan that has been stopped. Also, because the level of the cooling performance is increased in the above-described manner, the decrease in the coolant temperature is promoted when the electric fan is operated. This reduces the time required to decrease the coolant temperature to the stop temperature at which the operation of the electric fan is stopped. As a result, the operation time of the electric fan is reduced. Because the operation of the electric fan is more quickly stopped, it is also possible to suppress the increase in the electric power consumed by operating the electric fan.

When the discharge flow rate is corrected based on the vehicle speed, the second flow rate correction means may increase the discharge flow rate as the vehicle speed increases. Thus, the discharge flow rate can be appropriately corrected.

In the above-described cooling apparatus, when the electric fan is operated, the second flow rate correction means may increase the discharge flow rate corrected based on the vehicle speed, as compared to when the electric fan is not operated.

When the electric fan is operated, the amount of air passing through the radiator increases, and therefore, the level of the radiation performance increases, as compared to when the electric fan is not operated. Thus, in the above-described cooling apparatus, the discharge flow rate, which is corrected based on the vehicle speed, is increased when the electric fan is operated. Thus, the discharge flow rate of the electric water pump is changed according to the level of the radiation performance of the radiator, which is changed according to the operating state of the electric fan, as well as according to the vehicle speed. This further increases the cooling efficiency when the electric fan is operated. Accordingly, it is possible to further increase the level of the cooling performance, while effectively using the electric power supplied to the electric water pump.

Also, because the level of the cooling performance is increased in the above-described manner, the decrease in the coolant temperature is promoted when the electric fan is operated. This reduces the time required to decrease the coolant temperature to the stop temperature at which the operation of the electric fan is stopped. As a result, the operation time of the electric fan is reduced. Because the operation of the electric fan is more quickly stopped, it is also possible to suppress the increase in the electric power consumed by operating the electric fan.

In the above-described cooling apparatus, the control device may variably control a rotational speed of the electric fan; and the second flow rate correction means may further correct the discharge flow rate corrected based on the vehicle speed, according to a rotational speed of the electric fan.

In the case where the rotational speed of the electric fan is variable when the electric fan is operated, as the rotational speed of the electric fan increases, the amount of air passing through the radiator increases, and the level of the radiation performance of the radiator increases. Thus, in the above-described cooling apparatus, the discharge flow rate, which is corrected based on the vehicle speed, is further corrected according to the rotational speed of the electric fan. Thus, the discharge flow rate of the electric water pump is changed according to the level of the radiation performance of the radiator, which is changed according to the rotational speed of the electric fan, as well as according to the vehicle speed. This further increases the cooling efficiency. Accordingly, it is possible to further increase the level of the cooling performance, while effectively using the electric power supplied to the electric water pump.

Also, because the level of the cooling performance is increased in the above-described manner, the decrease in the coolant temperature is promoted to a larger extent as the rotational speed of the electric fan increases. Therefore, the rotational speed of the electric fan is more quickly decreased. This suppresses the increase in the electric power consumed by operating the electric fan.

When the discharge flow rate is corrected according to the rotational speed of the electric fan, the discharge flow rate may be corrected based on the electric power supplied to the electric motor that operates the electric fan (for example, based on the voltage or the electric current, or based on the duty ratio when the rotational speed of the electric fan is changed through a duty control). Also, the actual rotational speed of the electric fan may be detected, and the discharge flow rate may be corrected based on the detected rotational speed.

When the discharge flow rate is corrected based on the rotational speed of the electric fan, the second flow rate correction means may increase the discharge flow rate as the rotational speed of the electric fan increases. Thus, the discharge flow rate can be appropriately corrected.

When the discharge flow rate is corrected based on the vehicle speed, the second flow rate correction means may correct the discharge flow rate based on the vehicle speed, when the temperature of the coolant is between a stop temperature at which the operation of the electric fan is stopped, and the operation temperature that is higher than the stop temperature.

In the above-described cooling apparatus, when the temperature of the coolant increases from a temperature in a temperature range below the stop temperature, the second flow rate correction means may increase the discharge flow rate in accordance with the increase in the temperature of the coolant so that the discharge flow rate is equal to the discharge flow rate corrected based on the vehicle speed, at a time point at which the temperature of the coolant reaches the stop temperature; and when the temperature of the coolant increases in a temperature range above the operation temperature, the first flow rate correction means may increase the discharge flow rate corrected based on the vehicle speed, in accordance with the increase in the temperature of the coolant.

In the above-described cooling apparatus, the first flow rate correction means may set a lower limit value of the discharge flow rate based on the temperature of the coolant; and when the target flow rate is equal to or lower than the lower limit value, the first flow rate correction means may set the target flow rate to the lower limit value.

When the discharge flow rate is corrected by the first flow rate correction means, the target flow rate, which is set according to the amount of heat generated in the engine, may be directly corrected using a correction value set based on the coolant temperature. However, when the amount of heat generated in the engine is small, the target flow rate, which should be corrected, is low. Therefore, in this case, even if the target flow rate is corrected using the correction value, the discharge flow rate may not be increased in accordance with the increase in the coolant temperature.

Thus, in the cooling apparatus, the minimum value of the discharge flow rate of the electric water pump is limited by at least the lower limit value set based on the coolant temperature. This reliably increases the discharge flow rate.

Similarly, when the second flow rate correction means corrects the discharge flow rate, the second flow rate correction means may set a lower limit value of the discharge flow rate based on the vehicle speed; and when the target flow rate is equal to or lower than the lower limit value, the second flow rate correction means may set the target flow rate to the lower limit value. Thus, the minimum value of the discharge flow rate of the electric water pump is limited by at least the lower limit value set based on the vehicle speed. This reliably increases the discharge flow rate.

In the above-described cooling apparatus, the control device may control the operation of the electric fan according to the temperature of the coolant and according to a parameter different from the temperature of the coolant; the second flow rate correction means may start to correct the discharge flow rate when the temperature of the coolant reaches a predetermined value; and when the electric fan is operated according to a request for operating the electric fan based on the parameter different from the temperature of the coolant, the control device may execute a predetermined value change control that increases the predetermined value as compared to when there is no request for driving the electric fan based on the parameter different from the temperature of the coolant.

If the discharge flow rate is corrected when the coolant temperature is low to some extent, the coolant may be excessively cooled. Thus, the discharge flow rate is corrected when the coolant temperature is equal to or higher than the predetermined value. This suppresses the coolant from being excessively cooled.

In the case where the operation of the electric fan is controlled based on the parameter different from the temperature of the coolant for the internal combustion engine, the electric fan may be operated even when the temperature of the coolant for the internal combustion engine is lower than the fan operation temperature. Thus, when the electric fan is operated based on the parameter different from the coolant temperature, the electric fan is operated according to a request different from a request for cooling the coolant for the internal combustion engine. Therefore, in this case, even if the discharge flow rate of the electric water pump is corrected based on the vehicle speed to increase the efficiency of cooling the coolant, the frequency of operating the electric fan is not reduced, and rather, the electric power consumed by the electric water pump may be increased due to the increase in the discharge flow rate.

Thus, in the above-described cooling apparatus, the predetermined value change control is executed. Accordingly, when the electric fan is operated according to the request for operating the electric fan based on the parameter different from the coolant temperature, the discharge flow rate is corrected at the high temperature of the coolant for the internal combustion engine, as compared to when there is no such a request. Therefore, it is possible to minimize the unnecessary increase in the electric power for the electric water pump, which does not contribute to the reduction of the frequency of operating the electric fan. Thus, it is possible to suppress the increase in the electric power consumed by the electric water pump when the coolant temperature is low, as compared to the case where the predetermined value change control is not executed.

In the above-described cooling apparatus, the control device may variably control a rotational speed of the electric fan; the second flow rate correction means may start to correct the discharge flow rate when the temperature of the coolant reaches a predetermined value; when the electric fan is operated according to a request for operating the electric fan based on a parameter different from the temperature of the coolant, and the rotational speed is higher than a preset value, the control device may execute a predetermined value change control that increases the predetermined value; and when the electric fan is operated according to the request for operating the electric fan based on the parameter different from the temperature of the coolant, and the rotational speed is equal to or lower than the preset value, the control device may not execute the predetermined value change control.

In the above-described cooling apparatus, when the electric fan is operated based on the parameter different from the temperature of the coolant for the internal combustion engine, and the rotational speed of the electric fan is equal to or lower than the preset value, the second flow rate correction means starts to correct the discharge flow rate at the low coolant temperature, as compared to when the predetermined value change control is executed. Therefore, it is possible to increase the efficiency of cooling the coolant, and to suppress the increase in the coolant temperature when the electric fan is operated at the rotational speed equal to or lower than the preset value. This suppresses the increase in the rotational speed of the electric fan due to the increase in the coolant temperature. As a result, it is possible to suppress the increase in the electric power consumed by the electric fan.

In the above-described cooling apparatus, the cooling apparatus may be provided in a vehicle that includes an air conditioning device; the air conditioning device may include a compressor that compresses a cooling medium, and a condenser that cools the cooling medium; the condenser may be cooled by the electric fan; the parameter is a discharge pressure of the compressor; and the control device may control the operation of the electric fan based on the discharge pressure.

In the case where the air conditioning device, which adjusts the temperature or the humidity in a vehicle cabin, when the discharge pressure of the compressor that compresses the cooling medium for the air conditioning device is high, and the level of a request for cooling the cooling medium is high, the condenser is cooled through the operation of the electric fan, and thus, the level of the radiation performance of the condenser is increased to promote the cooling of the cooling medium. In the case where such an air conditioning device is provided, the discharge pressure of the compressor may be employed as the parameter which is used to control the operation of the electric fan, and which is different from the temperature of the coolant for the internal combustion engine.

In the above-described cooling apparatus, the cooling apparatus may be provided in a vehicle that includes an internal combustion engine and an electric motor that are used as power sources; the vehicle may include an inverter that converts electric power to be supplied from a storage battery to the electric motor, an inverter pipe through which an inverter coolant that cools the inverter flows, and an inverter radiator to which the inverter pipe is connected; the inverter radiator may be cooled by the electric fan; the parameter may be a temperature of the inverter coolant; and the control device may control the operation of the electric fan based on the temperature of the inverter coolant.

In the vehicle that includes the internal combustion engine and the electric motor that are used as power sources, the electric power to be supplied from the storage battery to the electric motor is converted by the inverter. Because heat is generated in the inverter when the inverter converts the electric power, the inverter is cooled by the inverter coolant. The inverter coolant is supplied to the inverter radiator through the inverter pipe, and heat of the inverter coolant is radiated by the inverter radiator. When the temperature of the inverter coolant is high, the inverter radiator is cooled through the operation of the electric fan. Thus, the level of the radiation performance of the inverter radiator is increased, and the cooling of the inverter coolant is promoted. In the case where such a cooling mechanism for the inverter is provided, the temperature of the inverter coolant may be employed as the parameter which is used to control the operation of the electric fan, and which is different from the temperature of the coolant for the internal combustion engine.

The above-described cooling apparatus may further include third flow rate correction means for correcting the discharge flow rate of the electric water pump based on an elapsed time after the operation of the electric fan is started.

The efficiency of cooling the coolant is increased by increasing the discharge flow rate of the electric water pump. Therefore, when the operation time of the electric fan (i.e., the elapsed time after the operation of the electric fan is started) is long, the decrease in the coolant temperature can be promoted, and thus, the electric fan can be more quickly stopped by increasing the discharge flow rate. Accordingly, in the above-described cooling apparatus, the discharge flow rate is corrected based on the operation time of the electric fan. Thus, the electric fan can be more quickly stopped after the operation of the electric fan is started. This suppresses the increase in the electric power consumed by the electric fan.

When the discharge flow rate is corrected based on the elapsed time after the operation of the electric fan is started, the third flow rate correction means may increase the discharge flow rate as the elapsed time increases.

In the above-described cooling apparatus, the third flow rate correction means may set a lower limit value of the discharge flow rate based on the elapsed time; and when the target flow rate is equal to or lower than the lower limit value, the third flow rate correction means may set the target flow rate to the lower limit value. With this configuration, the discharge flow rate is appropriately corrected.

When the third flow rate correction means corrects the discharge flow rate, the target flow rate, which is set based on the amount of heat generated in the engine, may be directly corrected using a correction value set based on the operation time of the electric fan. However, when the amount of heat generated in the engine is small, the target flow rate, which should be corrected, is low. Therefore, in this case, even if the target flow rate is corrected using the correction value, the discharge flow rate may not be increased in accordance with the increase in the coolant temperature.

Thus, in the above-described cooling apparatus, the minimum value of the discharge flow rate of the electric water pump is limited by at least the lower limit value set based on the operation time of the electric fan. This reliably increases the discharge flow rate.

In the above-described cooling apparatus, the target flow rate may be set based on an engine speed and an engine load.

The amount of heat generated in the engine tends to increase as the engine speed increases, and as the engine load increases. Accordingly, in the above-described cooling apparatus, the target flow rate is set based on the engine speed and the engine load. Thus, the target flow rate can be set according to the amount of heat generated in the engine. In the above-described cooling apparatus, the target flow rate may be set to increase as the engine speed increases, and as the engine load increases.

A second aspect of the invention relates to a cooling method for an internal combustion engine, in which the internal combustion engine is cooled by circulating a coolant in a cooling pipe provided for the internal combustion engine, radiating heat of the coolant using a radiator, and cooling the radiator using an electric fan. The cooling method includes setting a target flow rate of the coolant according to an amount of heat generated in the internal combustion engine; setting a lower limit value of a discharge flow rate of the coolant based on a temperature of the coolant, when the temperature of the coolant is equal to or higher than an operation temperature at which operation of the electric fan is started; controlling the discharge flow rate of the coolant based on the lower limit value, when the target flow rate is equal to or lower than the lower limit value; and controlling the discharge flow rate of the coolant based on the target flow rate, when the target flow rate is higher than the lower limit value.

The cooling method according to the second aspect may further include setting a first lower limit value of the discharge flow rate of the coolant based on the temperature of the coolant and a vehicle speed, when the temperature of the coolant is equal to or higher than a first predetermined value that is lower than the operation temperature; controlling the discharge flow rate of the coolant based on the first lower limit value, when the target flow rate is equal to or lower than the first lower limit value; and controlling the discharge flow rate of the coolant based on the target flow rate, when the target flow rate is higher than the first lower limit value.

The cooling method according to the second aspect may further include setting a second lower limit value of the discharge flow rate of the coolant based on the temperature of the coolant and a vehicle speed, when the electric fan is operated according to a request for operating the electric fan based on a parameter different from the temperature of the coolant, and the temperature of the coolant is equal to or higher than a second predetermined value that is higher than the first predetermined value and lower than the operation temperature; controlling the discharge flow rate of the coolant based on the second lower limit value, when the target flow rate is equal to or lower than the second lower limit value; and controlling the discharge flow rate of the coolant based on the target flow rate, when the target flow rate is higher than the second lower limit value.

The cooling method according to the second aspect may further include setting a first lower limit value of the discharge flow rate of the coolant based on the temperature of the coolant and a vehicle speed, when the electric fan is operated at a rotational speed equal to or lower than a preset value according to a request for operating the electric fan based on a parameter different from the temperature of the coolant, and the temperature of the coolant is equal to or higher than a first predetermined value that is lower than the operation temperature; controlling the discharge flow rate of the coolant based on the first lower limit value, when the target flow rate is equal to or lower than the first lower limit value; controlling the discharge flow rate of the coolant based on the target flow rate, when the target flow rate is higher than the first lower limit value; setting a second lower limit value of the discharge flow rate of the coolant based on the temperature of the coolant and the vehicle speed, when the electric fan is operated at a rotational speed higher than the preset value according to the request for operating the electric fan based on the parameter different from the temperature of the coolant, and the temperature of the coolant is equal to or higher than a second predetermined value that is higher than the first predetermined value and lower than the operation temperature; controlling the discharge flow rate of the coolant based on the second lower limit value, when the target flow rate is equal to or lower than the second lower limit value; and controlling the flow rate of the coolant based on the target flow rate, when the target flow rate is higher than the second lower limit value.

According to the cooling method in the above-described aspect, it is possible to increase the efficiency of cooling the internal combustion engine, and to reduce the operation time of the electric fan. Accordingly, it is also possible to suppress the increase in the electric power consumed by operating the electric fan.

BRIEF DESCRIPTION OF THE DRAWINGS

The foregoing and further objects, features and advantages of the invention will become apparent from the following description of embodiments with reference to the accompanying drawings, wherein like numerals are used to represent like elements and wherein.

DETAILED DESCRIPTION OF EMBODIMENTS

First Embodiment

Hereinafter, a cooling apparatus for an internal combustion engine according to a first embodiment of the invention will be described with reference to FIG. 1 to FIG. 6.

Figure 1:
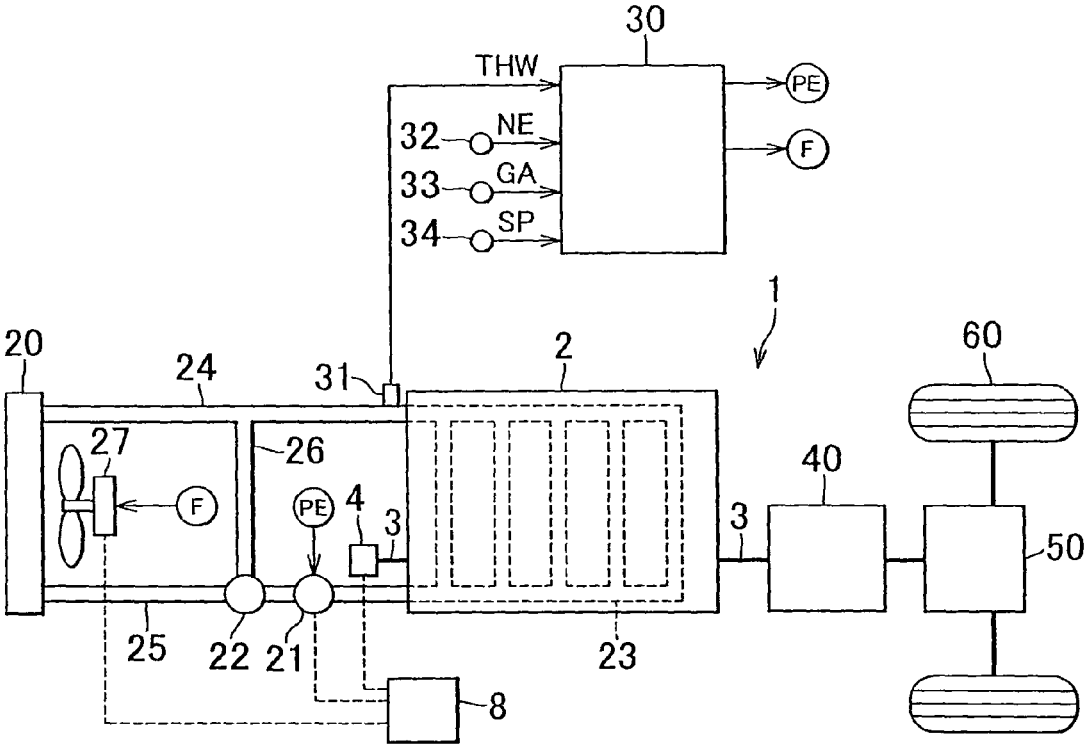
FIG. 1 is a schematic configuration diagram showing a cooling apparatus for an internal combustion engine according to a first embodiment of the invention, and a configuration around the cooling apparatus.

FIG. 1 is a schematic configuration diagram showing the configuration of a cooling apparatus according to the embodiment, and a configuration around the cooling apparatus. In an engine 2 provided in a vehicle 1, air supplied through an intake passage and fuel injected from a fuel injection valve are introduced into a combustion chamber. Air-fuel mixture, which is mixture of air and the fuel, is burned in the combustion chamber. A piston is reciprocated by combustion of the air-fuel mixture. The reciprocating movement is transmitted to a crankshaft 3 via a connecting rod, and thus, the crankshaft 3 is rotated. The rotation of the crankshaft 3 is transmitted to wheels 60 via a transmission 40 and a speed reducer 50. The crankshaft 3 is operatively connected to an alternator 4 that is a power generator. Electric power generated by the alternator 4 is stored in a battery 8.

A cooling apparatus is provided for the engine 2 to cool the engine 2 in which heat is generated due to the combustion of the air-fuel mixture. The cooling apparatus includes a radiator 20 that is a heat exchanger, an electric water pump 21, a thermostat 22, and a cooling passage. In the engine 2, a water jacket 23 is formed. The water jacket 23 is a passage through which a coolant flows.

One end of a first coolant passage 24 is connected to the outlet of the water jacket 23. The other end of the first coolant passage 24 is connected to the inlet of the radiator 20. One end of a second coolant passage 25 is connected to the outlet of the radiator 20. The other end of the second coolant passage 25 is connected to the inlet of the water jacket 23.

The water jacket 23, the first coolant passage 24, the second coolant passage 25, and the radiator 20 are filled with the coolant. When the coolant passes through the water jacket 23, the coolant receives heat from the engine 2. Then, the coolant is introduced into the radiator 20 via the first coolant passage 24. Heat is transferred from the coolant in the radiator 20, and thus, the coolant is cooled. The cooled coolant is returned to the water jacket 23 via the second coolant passage 25. By circulating the coolant in this manner, the engine 2 is cooled.

The electric water pump 21, which is operated by an electric motor, is provided in the second coolant passage 25. By controlling electric power supplied from the battery 8 to the electric water pump 21, the discharge flow rate of the electric water pump 21 is adjusted; and thus, the circulation amount of coolant, that is, the amount of coolant flowing in the cooling apparatus is adjusted.

One end of a bypass passage 26 is connected to the second coolant passage 25 at a position upstream of the electric water pump 21. The other end of the bypass passage 26 is connected to the first coolant passage 24. The thermostat 22 is provided at a connection portion at which the second coolant passage 25 and the bypass passage 26 are connected to each other. In the thermostat 22, a valve element is placed in an open position and a closed position according to the temperature of the coolant (hereinafter, referred to as "coolant temperature"). When the coolant temperature is equal to or lower than a predetermined value, the valve element of the thermostat 22 is placed in the closed position. As a result, communication between the radiator 20 and the second coolant passage 25 is interrupted, and communication between the bypass passage 26 and the second coolant passage 25 is permitted. Thus, the coolant, which flows from the water jacket 23 into the first coolant passage 24, bypasses the radiator 20, and returns to the water jacket 23. By circulating the coolant in this manner, the coolant is gradually warmed, and warming-up of the engine 2 is promoted.

When the coolant temperature is higher than the predetermined value, the valve element of the thermostat 22 is placed in the open position. As a result, communication between the radiator 20 and the second coolant passage 25 is permitted, and communication between the bypass passage 26 and the second coolant passage 25 is interrupted. Thus, the coolant, which flows from the water jacket 23 into the first coolant passage 24, is supplied to the radiator 20. After the coolant is cooled in the radiator 20, the coolant is delivered to the water jacket 23. By circulating the coolant in this manner, the engine 2 is cooled. Also, the radiator 20 radiates heat of the coolant to the outside, thereby cooling the coolant.

An electric fan 27, which is operated by the electric motor, is provided for the radiator 20. By operating the electric fan 27 using the electric power of the battery 8, the radiator 20 is forcibly cooled.

Sensors, which detect an engine operating state and the like, are provided for the engine 2. For example, a coolant sensor 31, which detects a coolant temperature THW, is provided near the outlet of the water jacket 23. An engine speed sensor 32, which detects an engine speed NE, is provided near the crankshaft 3. An airflow meter 33, which detects an intake air amount GA, is provided in the intake passage for the engine 2. A vehicle speed sensor 34, which detects a vehicle speed SP of a vehicle 1, is also provided.

A control device 30 executes controls, such as the control of an ignition timing and the control of fuel injection in the engine 2, the control of the amount of power generated by the alternator 4, the control of operation of the electric fan 27, and the control of operation of the electric water pump 21. The control device 30 mainly includes a microcomputer that includes a central processing unit (CPU). The control device 30 includes a read-only memory (ROM), a random access memory (RAM), an input interface, and an output interface. In the read-only memory (ROM), for example, programs and maps are stored in advance. In the random access memory (RAM), for example, the results of calculations performed by the CPU are temporarily stored. The control device 30 detects the operating state of the engine 2 based on signals output from the above-described sensors, and appropriately executes the above-described controls based on the detected operating state.

For example, the control device 30 monitors the voltage and electric current of the battery 8. When the amount of electric power consumed in the vehicle is increased, the control device 30 increases the amount of power generated by the alternator 4, by controlling the alternator 4. When the amount of electric power generated by the alternator 4 is thus increased, the operating load of the alternator 4 is increased. Therefore, the output from the engine 2 is increased in accordance with the increase in the operating load, by increasing the amount of fuel injected from a fuel injection valve.

Figure 2:
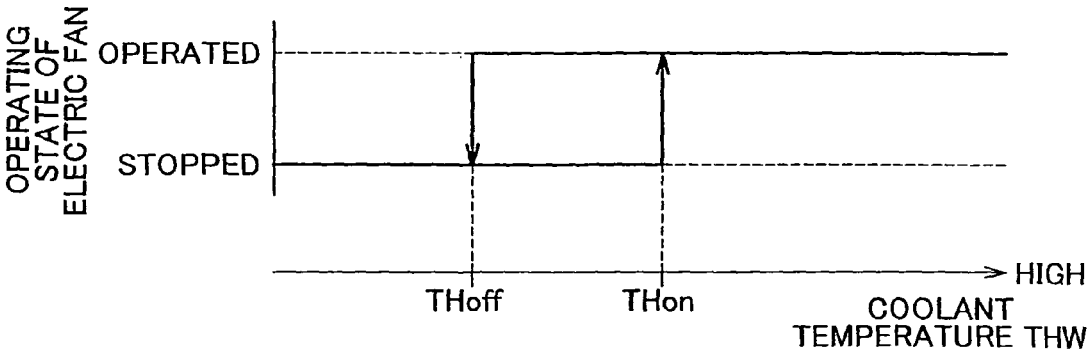
FIG. 2 is a schematic diagram showing the manner in which an electric fan is operated in the first embodiment.

As shown in FIG. 2, when the coolant temperature THW is equal to or higher than a predetermined fan operation temperature THon at which operation of the electric fan 27 is started, the electric fan 27 is operated to decrease the coolant temperature THW. When the coolant temperature THW is decreased to a fan stop temperature THoff that is lower than the fan operation temperature THon after the operation of the electric fan 27 is started, the operation of the electric fan 27 is stopped.

Also, the control device 30 sets a target flow rate Vwp of the electric water pump 21 in the manner described below. That is, the amount of heat generated in the engine 2 tends to increase, as the engine speed NE increases, and as an engine load KL increases. Thus, to set the target flow rate Vwp according to the amount of heat generated in the engine 2, the target flow rate Vwp is set based on the engine speed NE and the engine load KL that are correlated with the amount of heat generated in the engine 2. Then, the control device 30 controls a discharge flow rate Vw of the electric water pump 21 based on the target flow rate Vwp that is set. Thus, the discharge flow rate Vw is adjusted based on a cooling request corresponding to the amount of heat generated in the engine 2, that is, the amount of heat of the coolant required to be radiated by the radiator 20. Thus, the coolant temperature is appropriately adjusted.

When the amount of heat generated in the engine 2 changes, for example, a response delay occurs in the adjustment of the coolant temperature THW performed through the control of the discharge flow rate Vw, and as a result, the coolant temperature THW may increase. Such an increase in the coolant temperature THW can be suppressed by increasing the operation amounts of the electric water pump 21 and the electric fan 27. The electric water pump 21 and the electric fan 27 consume electric power when the electric water pump 21 and the electric fan 27 are operated. Therefore, unless the electric water pump 21 and the electric fan 27 are controlled taking into account the efficiency of cooling the coolant, the electric power consumed in the vehicle 1 may be excessively increased. If the electric power is excessively increased, for example, the operating load of the alternator 4 is increased, which adversely affects the fuel efficiency of the engine 2.

Figure 3:
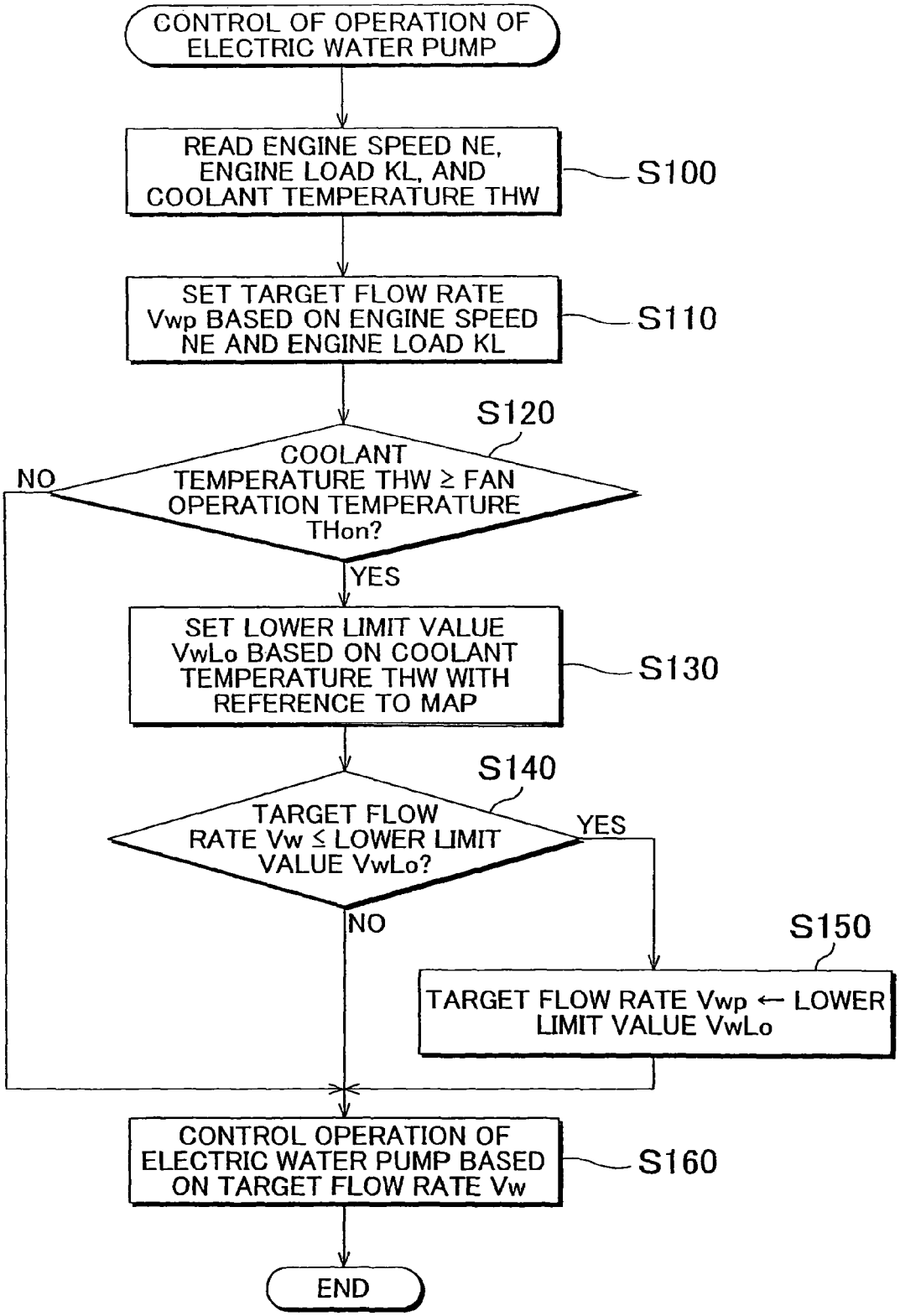
FIG. 3 is a flowchart showing the control of the operation of an electric water pump in the first embodiment.

In the embodiment, taking the above into account, the operation of the electric water pump 21 is controlled in the manner described below. FIG. 3 shows steps of the control of the operation of the electric water pump 21. The control device 30 repeatedly executes the operation control at predetermined time intervals.

When the control is started, first, the engine speed NE, the engine load KL, and the coolant temperature THW are read (S100). In the embodiment, the engine load KL is a ratio of the current intake air amount GA to an intake air amount at engine full load. However, for example, the engine load KL may be calculated based on the amount of fuel injected from the fuel injection valve, the opening degree of a throttle valve provided in the intake passage, or the operation amount of an accelerator pedal.

Next, the target flow rate Vwp of the electric water pump 21 is set based on the engine speed NE and the engine load KL (S110). The amount of heat generated in the engine 2 increases as the engine speed NE increases, and as the engine load KL increases. Therefore, the target flow rate Vwp is set to increase as the engine speed NE or the engine load KL increases. Thus, the target flow rate Vwp is set based on the amount of heat generated in the engine 2.

Next, it is determined whether the coolant temperature THW is equal to or higher than the fan operation temperature THon (S120). When it is determined that the coolant temperature THW is lower than the fan operation temperature THon (NO in step S120), the operation of the electric water pump 21 is controlled based on the target flow rate Vwp (S160). In step S160, an operation duty D, which is a duty ratio of electric power supplied to the electric water pump 21, is set based on the target flow rate Vwp, using a map stored in the memory of the control device 30. Thus, the actual discharge flow rate Vw of the electric water pump 21 is adjusted to the target flow rate Vwp. The operation duty D is increased as the target flow rate Vwp increases. Accordingly, the actual discharge flow rate Vw is also increased as the target flow rate Vwp increases. Thus, the control is finished.

When it is determined that the coolant temperature THW is equal to or higher than the fan operation temperature THon in step S120 (YES in S120), the lower limit value VwLo of the discharge flow rate Vw is set based on the coolant temperature THW (S130). In step S130, the lower limit value VwLo is variably set using the map stored in the memory of the control device 30.

Figure 4:
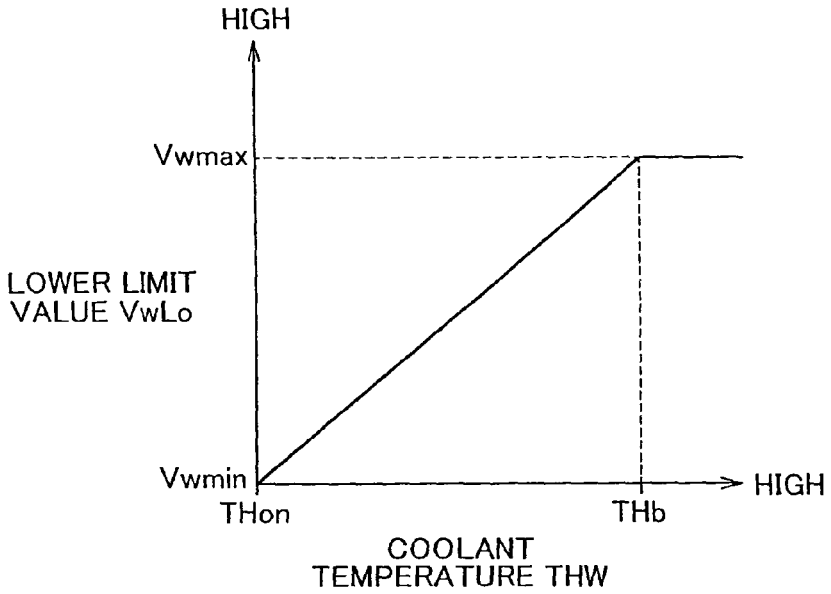
FIG. 4 is a graph showing the manner in which a lower limit value map is set in the first embodiment.

More specifically, as shown in FIG. 4, when the coolant temperature THW is equal to the fan operation temperature THon, the lower limit value VwLo is set to the minimum discharge flow rate Vwmin of the electric water pump 21. Then, when the coolant temperature THW is higher than the fan operation temperature THon, as the coolant temperature THW increases, the lower limit value VwLo increases. When the coolant temperature THW is equal to or higher than a maximum required radiation temperature THb, the lower limit value VwLo is set to the maximum discharge flow rate Vwmax of the electric water pump 21. The maximum required radiation temperature THb is the temperature at which the amount of heat required to be radiated reaches the maximum value. The maximum required radiation temperature THb is set to be lower than a permissible highest temperature THmax by a predetermined margin $\alpha$. Thus, the lower limit value VwLo is variably set so that the lower limit value VwLo is increased as the coolant temperature THW increases.

After the lower limit value VwLo is set in the above-described manner, it is determined whether the target flow rate Vwp is equal to or lower than the lower limit value VwLo (S140). When it is determined that the target flow rate Vwp is higher than the lower limit value VwLo (NO in step S140), the operation of the electric water pump 21 is controlled based on the target flow rate Vwp set in the previous step S110 (S160). Thus, the control is finished.

When it is determined that the target flow rate Vwp is equal to or lower than the lower limit value VwLo (YES in step S140), the target flow rate Vwp set in the previous step S110 is changed to the lower limit value VwLo (S150). Then, the operation of the electric water pump 21 is controlled based on the target flow rate Vwp that is changed to the lower limit value VwLo, that is, the operation of the electric water pump 21 is actually controlled based on the lower limit value VwLo (S160). Thus, the control is finished. The processes in step S120 to step S150 constitute the first flow rate correction means.

Figure 5:
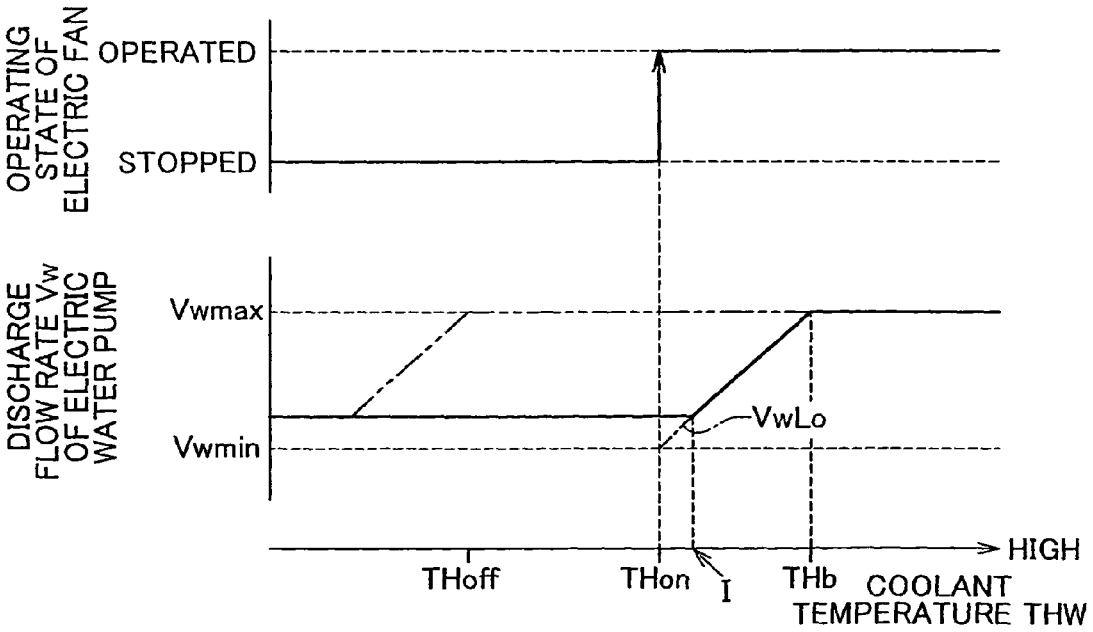
FIG. 5 is a timing chart showing the effect of the control of the operation of the electric water pump in the first embodiment.

FIG. 5 shows the effect of the above-described control of the operation of the electric water pump 21. First, when the coolant temperature THW is lower than the fan operation temperature THon, the operation of the electric water pump 21 is controlled based on the target flow rate Vwp set based on the amount of heat generated in the engine 2.

When the coolant temperature THW reaches the fan operation temperature THon, the operation of the electric fan 27 is started, and the setting of the lower limit value VwLo of the target flow rate Vwp of the electric water pump 21 is started. As the coolant temperature THW increases, the lower limit value VwLo is gradually increased. The target flow rate Vwp is equal to the lower limit valve VwLo at timing I, and the target flow rate Vwp is lower than the lower limit value VwLo after timing I. Thus, after timing I, the operation of the electric water pump 21 is controlled based on the lower limit value VwLo. More specifically, the discharge flow rate Vw of the electric water pump 21 is gradually increased in accordance with the increase in the lower limit value VwLo due to the increase in the coolant temperature THW. After the coolant temperature THW reaches the maximum required radiation temperature THb, the discharge flow rate Vw of the electric water pump 21 is adjusted to the maximum discharge flow rate Vwmax.

According to the above-described embodiment, it is possible to obtain advantageous effects described below. (1) The discharge flow rate Vw of the electric water pump 21 is controlled based on the engine speed NE and the engine load KL that are correlated with the amount of heat generated in the engine 2. When the amount of heat generated in the engine 2 changes, for example, a response delay occurs in the adjustment of the coolant temperature THW performed through the control of the discharge flow rate Vw, and as a result, the coolant temperature THW may increase. Accordingly, in the embodiment, in such a situation where the coolant temperature THW increases, the increase in the coolant temperature THW is suppressed by increasing the discharge flow rate Vw in accordance with the increase in the coolant temperature THW.

If the electric fan 27 is not operated when the discharge flow rate Vw is increased as shown by the two-dot chain line in FIG. 5, the amount of coolant supplied to the radiator 20 may be so large that the heat of the coolant cannot be sufficiently radiated by the radiator 20. In this case, the coolant may not be efficiently cooled although the operation duty D of the electric water pump 21 is increased. Thus, the cooling efficiency may not be increased by the increase in the amount of electric power for driving the electric water pump 21. Accordingly, the electric power may be wasted.

Thus, in the embodiment, when the coolant temperature THW is equal to or higher than the fan operation temperature THon, the discharge flow rate Vw is increased, as described above. Therefore, the electric fan 27 is operated when the flow rate of the coolant supplied to the radiator 20 is increased. Thus, the discharge flow rate Vw is increased when the level of the radiation performance of the radiator 20 is high. Accordingly, it is possible to increase the level of the cooling performance, without wasting the electric power for driving the electric water pump 21 increased by increasing the operation duty D. Thus, the operation of the electric water pump 21 and the operation of the electric fan 27 are appropriately controlled. Also, the discharge flow rate Vw is gradually increased in accordance with the increase in the coolant temperature THW. Therefore, it is possible to appropriately suppress the increase in the electric power consumed by the electric water pump 21, as compared to the case where the discharge flow rate Vw is sharply increased when the coolant temperature THW is higher than the fan operation temperature THon.

(2) When the coolant temperature THW increases, and the discharge flow rate Vw is increased, the target flow rate Vwp, which is set based on the amount of heat generated in the engine 2, may be directly corrected by a correction value set based on the coolant temperature THW. However, if the target flow rate Vwp is directly corrected, the following problem may occur. When the amount of heat generated in the engine 2 is small, the target flow rate Vwp, which should be corrected, is low. Therefore, in this case, even if the target flow rate Vwp is corrected using the correction value, the discharge flow rate Vw may not be increased in accordance with the increase in the coolant temperature THW.

Thus, in the embodiment, the lower limit value VwLo of the discharge flow rate Vw is set based on the coolant temperature THW. When the target flow rate Vwp is equal to or lower than the lower limit value VwLo, the target flow rate Vwp is set to the lower limit value VwLo. Therefore, the minimum value of the discharge flow rate Vw of the electric water pump 21 is limited by at least the lower limit value VwLo set based on the coolant temperature THW. This reliably increases the discharge flow rate Vw.

(3) When the coolant temperature THW is equal to or higher than the maximum required radiation temperature THb (i.e., the temperature lower than the permissible highest temperature THmax by the predetermined margin $\alpha$), the lower limit value VwLo is set to the maximum value, that is, the maximum discharge flow rate Vwmax of the electric water pump 21. Therefore, when the coolant temperature THW increases to a temperature close to the permissible highest temperature THmax, and the amount of heat of the coolant required to be radiated reaches the maximum value, the discharge flow rate Vw of the electric water pump 21 is increased to the maximum value. When the discharge flow rate Vw is the maximum value, the electric fan 27 is operated. Thus, when the amount of heat required to be radiated is the maximum value, the electric fan 27 is operated, and the electric water pump 21 is operated in a manner such that the discharge flow rate Vw is the maximum value, and therefore, the amount of heat of the coolant radiated by the radiator 20 is the maximum value. Accordingly, when the amount of heat of the coolant required to be radiated is the maximum value, the level of the performance of cooling the coolant is increased to the highest level.

Second Embodiment

Next, a cooling apparatus for an internal combustion engine according to a second embodiment of the invention will be described with reference to FIG. 6 to FIG. 10, focusing on differences between the first embodiment and the second embodiment.

In the control of the operation of the electric water pump 21 in the first embodiment, when the coolant temperature THW is higher than the fan operation temperature THon, the discharge flow rate Vw of the electric water pump 21 is corrected based on the coolant temperature THW.

As a vehicle speed of the vehicle 1 increases, the amount of air passing through the radiator 20 increases, and the level of the radiation performance of the radiator 20 increases. Accordingly, in the control of the operation of the electric water pump 21 in the second embodiment, when the discharge flow rate Vw is controlled, the discharge flow rate Vw is corrected based on the vehicle speed.

Figure 6:
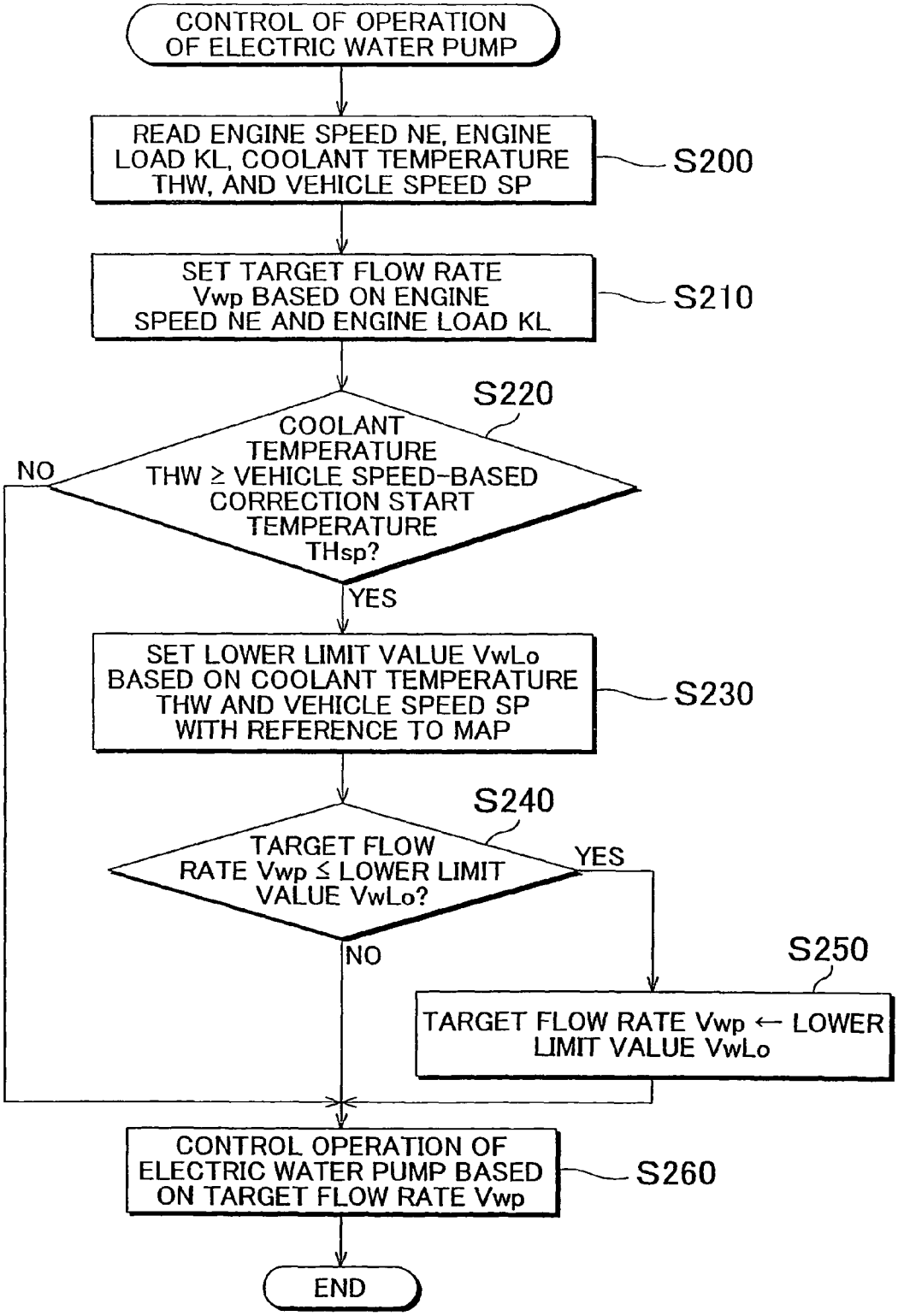
FIG. 6 is a flowchart showing the control of the operation of the electric water pump in a second embodiment.

FIG. 6 shows steps of the control of the operation of the electric water pump 21 in the second embodiment. The control is also repeatedly executed by the control device 30 at predetermined time intervals. When the control is started, first, the engine speed NE, the engine load KL, the coolant temperature THW, and the vehicle speed SP are read (S200). In the second embodiment as well, the engine load KL is the ratio of the current intake air amount GA to the intake air amount at engine full load. However, for example, the engine load KL may be calculated based on the amount of fuel injected from the fuel injection value, the opening degree of the throttle valve provided in the intake passage, or the operation amount of the accelerator pedal.

Next, the target flow rate Vwp of the electric water pump 21 is set based on the engine speed NE and the engine load KL (S210). The amount of heat generated in the engine 2 increases as the engine speed NE increases, and as the engine load KL increases. Therefore, the target flow rate Vwp is set to increase as the engine speed NE or the engine load KL increases.

Next, it is determined whether the coolant temperature THW is equal to or higher than a vehicle speed-based correction start temperature THsp (S220): This determination process is performed for the following reason. If the discharge flow rate Vw is corrected when the coolant temperature THW is low to some extent, the coolant may be excessively cooled. Thus, the discharge flow rate Vw is corrected when the coolant temperature THW is equal to or higher than the predetermined value, that is, the above-described vehicle speed-based correction start temperature THsp. This reduces the possibility that the coolant is excessively cooled. In the second embodiment, the vehicle speed-based correction start temperature THsp is set to a temperature at which the valve element of the thermostat 22 is opened. The vehicle speed-based correction start temperature THsp is set to be lower than the fan stop temperature THoff. However, the vehicle speed-based correction start temperature THsp may be set to other temperatures.

When the coolant temperature THW is lower than the vehicle speed-based correction start temperature THsp (NO in step S220), the operation of the electric water pump 21 is controlled based on the target flow rate Vwp (S260). In step S260 as well, the operation duty D, which is the duty ratio of electric power supplied to the electric water pump 21, is set based on the target flow rate Vwp, using the map stored in the memory of the control device 30. Thus, the actual discharge flow rate Vw of the electric water pump 21 is adjusted to the target flow rate Vwp. The operation duty D is increased as the target flow rate Vwp increases. Accordingly, the actual discharge flow rate Vw is also increased as the target flow rate Vwp increases. Thus, the control is finished.

Figure 7:
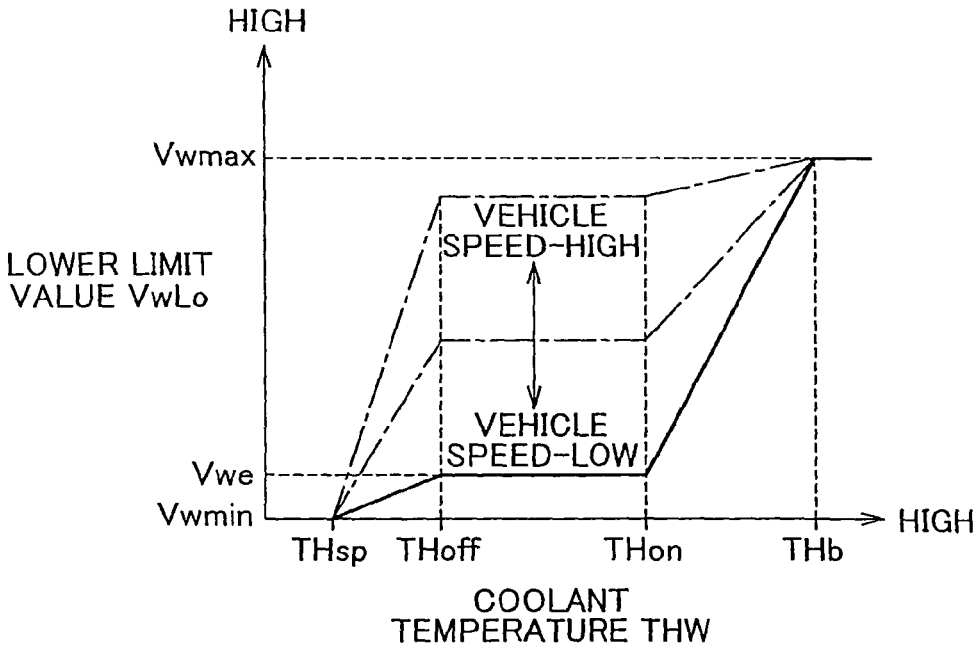
FIG. 7 is a graph showing the manner in which a lower limit value map is set in the second embodiment.

When it is determined that the coolant temperature THW is equal to or higher than the vehicle speed-based correction start temperature THsp in step S220 (YES in step S220), the lower limit value VwLo of the discharge flow rate Vw is set based on the coolant temperature THW and the vehicle speed SP (S230). In step S230, the lower limit value VwLo is variably set using a lower limit value map stored in the memory of the control device 30. More specifically, as shown in FIG. 7, when the coolant temperature THW is equal to the vehicle speed-based correction start temperature THsp, the lower limit value VwLo is set to the minimum discharge flow rate Vwmin of the electric water pump 21. When the coolant temperature THW increases after the coolant temperature THW reaches the vehicle speed-based correction start temperature THsp, the lower limit value VwLo is increased in accordance with the increase in the coolant temperature THW so that the lower limit value VwLo is set to an efficient flow rate Vwe set based on the vehicle speed SP, at the time point at which the coolant temperature THW reaches the fan stop temperature THoff. When the coolant temperature THW is between the fan stop temperature THoff and the fan operation temperature THon, the lower limit value VwLo is maintained at the efficient flow rate Vwe. When the coolant temperature THW increases after the coolant temperature THW reaches the fan operation temperature THon, the lower limit value VwLo is increased in accordance with the increase in the coolant temperature THW so that the lower limit value VwLo is set to the maximum discharge flow rate Vwmax of the electric water pump 21 at the time point at which the coolant temperature THW reaches the maximum required radiation temperature THb. Then, after the coolant temperature THW reaches the maximum required radiation temperature THb, the lower limit value VwLo is set to the maximum discharge flow rate Vwmax of the electric water pump 21.

Figure 8:
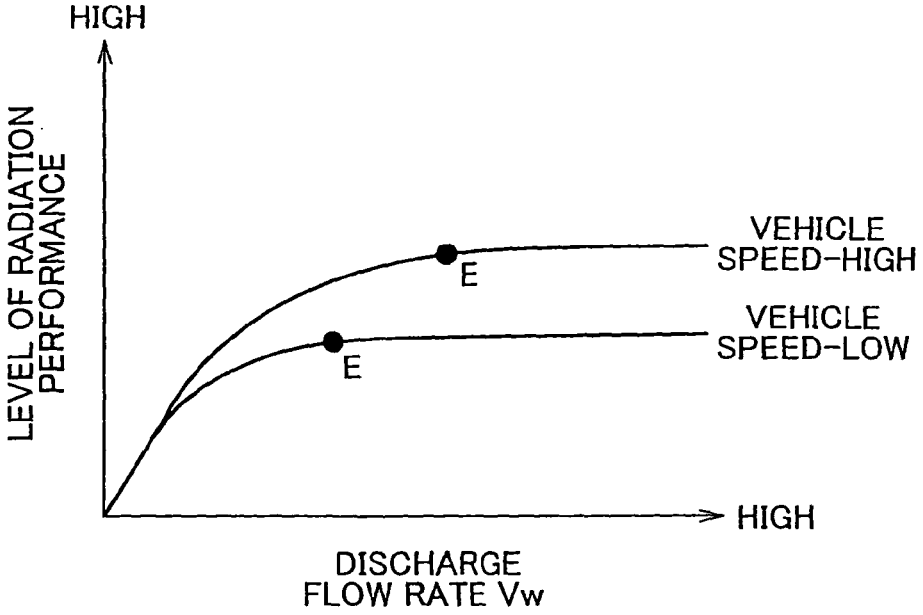
FIG. 8 is a graph showing a relation between a discharge flow rate/a vehicle speed, and the level of radiation performance of a radiator.
Figure 9:
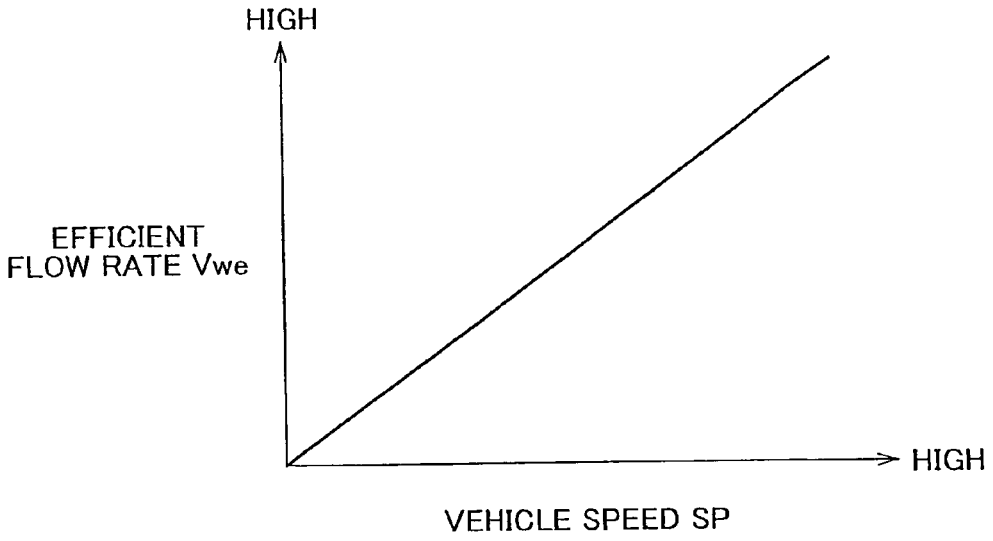
FIG. 9 is a graph showing a relation between the vehicle speed and an efficient flow rate.

The efficient flow rate Vwe is set in the manner described below. As shown in FIG. 8, as the discharge flow rate Vw of the electric water pump 21 is increased, the level of the radiation performance of the radiator 20 is increased. However, after the discharge flow rate Vw reaches a certain flow rate E, the level of the radiation performance is not greatly increased even if the discharge flow rate Vw is increased. Accordingly, when the discharge flow rate Vw is equal to the flow rate E, the electric power supplied to the electric water pump 21 is most effectively used, and the level of the radiation performance is the highest level. The above-described efficient flow rate Vwe is set to the flow rate E. As shown in FIG. 8, because the amount of air passing through the radiator 20 increases as the vehicle speed SP increases, the flow rate E increases as the vehicle speed SP increases. Thus, in the above-described lower limit value map, the efficient flow rate Vwe is set to increase as the vehicle speed SP increases as shown in FIG. 9. Accordingly, as shown by the chain line in FIG. 7, when the coolant temperature THW is in a range above the vehicle speed-based correction start temperature THsp and below the maximum required radiation temperature THb, the lower limit value VwLo is increased as the vehicle speed SP increases even if the coolant temperature THW remains the same. Thus, the lower limit value VwLo is variably set so that the lower limit value VwLo is increased as the coolant temperature THW increases, and as the vehicle speed SP increases.

Next, after the lower limit value VwLo is set, it is determined whether the target flow rate Vwp is equal to or lower than the lower limit value VwLo (S240). When the target flow rate Vwp is higher than the lower limit value VwLo (NO in step S240), the operation of the electric water pump 21 is controlled based on the target flow rate Vwp set in the previous step S210 (S260). Thus, the control is finished.

When the target flow rate Vwp is equal to or lower than the lower limit value VwLo (YES in step S240), the target flow rate Vwp set in the previous step S210 is changed to the lower limit value VwLo (S250). The operation of the electric water pump 21 is controlled based on the target flow rate Vwp that is changed to the lower limit value VwLo, that is, the operation of the electric water pump 21 is actually controlled based on the lower limit value VwLo (S260). Thus, the control is finished.

Among processes in step 220 to step S250, processes, which are executed to increase the discharge flow rate Vw in accordance with the increase in the coolant temperature THW when the coolant temperature THW is higher than the fan operation temperature THon, constitute the first flow rate correction means. Processes, which are executed to correct the discharge flow rate Vw based on the vehicle speed SP, constitute the second flow rate correction means.

Figure 10:
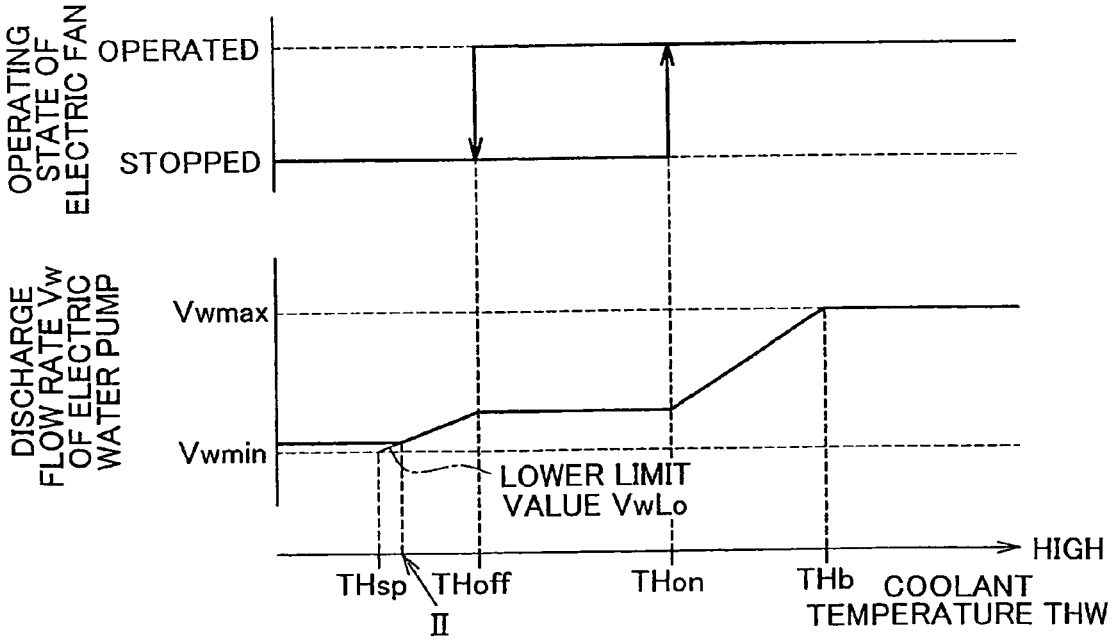
FIG. 10 is a timing chart showing the effect of the control of the operation of the electric water pump in the second embodiment.

FIG. 10 shows the effect of the above-described control of the operation of the electric water pump 21. First, when the coolant temperature THW is lower than the vehicle speed-based correction start temperature THsp, the operation of the electric water pump 21 is controlled based on the target flow rate Vwp set based on the amount of heat generated in the engine 2. When the coolant temperature THW reaches the vehicle speed-based correction start temperature THsp, the setting of the lower limit value VwLo is started. The lower limit value VwLo is gradually increased as the coolant temperature THW increases. The target flow rate Vwp is equal to the lower limit valve VwLo at timing II, and the target flow rate Vwp is lower than the lower limit value VwLo after timing II. Thus, after timing II, the operation of the electric water pump 21 is controlled based on the lower limit value VwLo. More specifically, the discharge flow rate Vw of the electric water pump 21 is gradually increased in accordance with the increase in the lower limit value VwLo due to the increase in the coolant temperature THW. When the coolant temperature THW is equal to or higher than the fan stop temperature THoff, and is equal to or lower than the fan operation temperature THon, the lower limit value VwLo is set to the efficient flow rate Vwe, and accordingly, the discharge flow rate Vw is also adjusted to the efficient flow rate Vwe.

When the coolant temperature THW is higher than the fan operation temperature THon, the operation of the electric fan 27 is started. In addition, as the coolant temperature THW increases, the discharge flow rate Vw is gradually increased from the efficient flow rate Vwe. After the coolant temperature THW reaches the maximum required radiation temperature THb, the discharge flow rate Vw is adjusted to the maximum discharge flow rate Vwmax.

Thus, when the coolant temperature THW is between the fan stop temperature THoff and the fan operation temperature THon, the discharge flow rate Vw is corrected based on the vehicle speed SP so that the discharge flow rate Vw is equal to the efficient flow rate Vwe that is changed according to the vehicle speed SP.

When the coolant temperature THW increases from a temperature in a temperature range below the fan stop temperature THoff, the discharge flow rate Vw is increased in accordance with the increase in the coolant temperature THW so that the discharge flow rate Vw is equal to the discharge flow rate corrected based on the vehicle speed SP, that is, the efficient flow rate Vwe, at the time point at which the coolant temperature THW reaches the fan stop temperature THoff. When the coolant temperature THW increases in a temperature range above the fan operation temperature THon, the discharge flow rate corrected based on the vehicle speed SP, that is, the efficient flow rate Vwe is increased in accordance with the increase in the coolant temperature THW.

According to the above-described embodiment, it is possible to obtain the following advantageous effects in addition to the advantageous effects obtained in the first embodiment.

(4) The discharge flow rate Vw of the electric water pump 21 is corrected based on the vehicle speed SP so that the discharge flow rate Vw is increased as the vehicle speed SP increases. Therefore, the discharge flow rate Vw of the electric water pump 21 is changed according to the level of the radiation performance of the radiator 20, which is changed according to the vehicle speed SP. Thus, the cooling efficiency is increased. Accordingly, it is possible to increase the level of the cooling performance, while effectively using the electric power supplied to the electric water pump 21.

Also, because the discharge flow rate Vw is increased, the level of the cooling performance is increased, and thus, the increase in the coolant temperature THW is suppressed. Therefore, when the electric fan 27 is not operated, the coolant temperature THW is unlikely to reach the fan operation temperature THon. This reduces the possibility that the electric fan 27 is operated due to the increase in the coolant temperature THW. Because the frequency of operating the electric fan 27 is reduced in this manner, it is possible to suppress the increase in the electric power consumed by operating the electric fan 27 that has been stopped.

Also, because the level of the cooling performance is increased by increasing the discharge flow rate Vw, the decrease in the coolant temperature THW is promoted when the electric fan 27 is operated. This reduces the time required to decrease the coolant temperature THW, which has been equal to or higher than the fan operation temperature THon, to the fan stop temperature THoff. Thus, the operation time of the electric fan 27 (i.e., the elapsed time after the operation of the electric fan 27 is started) is reduced. Because the operation of the electric fan 27 is more quickly stopped, the electric power consumed by operating the electric fan 27 is suppressed. In other words, it is possible to reduce the amount of electric power consumed by the electric fan 27 (i.e., a product of the consumed electric power and the time during which the electric power is consumed).

(5) When the discharge flow rate Vw is increased based on the vehicle speed SP, the target flow rate Vwp, which is set based on the amount of heat generated in the engine 2, may be directly corrected using a correction value set based on the vehicle speed SP. However, if the target flow rate Vwp is directly corrected, the following problem may occur. When the amount of heat generated in the engine 2 is small, the target flow rate Vwp, which should be corrected, is low. Therefore, in this case, even if the target flow rate Vwp is corrected using the correction value, the discharge flow rate Vw may not be increased to the efficient flow rate Vwe that is changed according to the vehicle speed SP.

Thus, in the embodiment, the lower limit value VwLo of the discharge flow rate Vw is set based on the vehicle speed SP. When the target flow rate Vwp is equal to or lower than the lower limit value VwLo, the target flow rate Vwp is set to the lower limit value VwLo. Therefore, the minimum value of the discharge flow rate Vw of the electric water pump 21 is limited by at least the lower limit value VwLo set based on the vehicle speed SP. This reliably increases the discharge flow rate Vw.

Third Embodiment

Next, a cooling apparatus for an internal combustion engine according to a third embodiment of the invention will be described with reference to FIG. 11 to FIG. 16, focusing on differences between the second embodiment and the third embodiment.

In the third embodiment, the cooling apparatus according to the invention is applied to a cooling apparatus for the engine 2 provided in a vehicle that includes the engine 2 and an electric motor that are used as power sources, that is, a hybrid vehicle.

Figure 11:
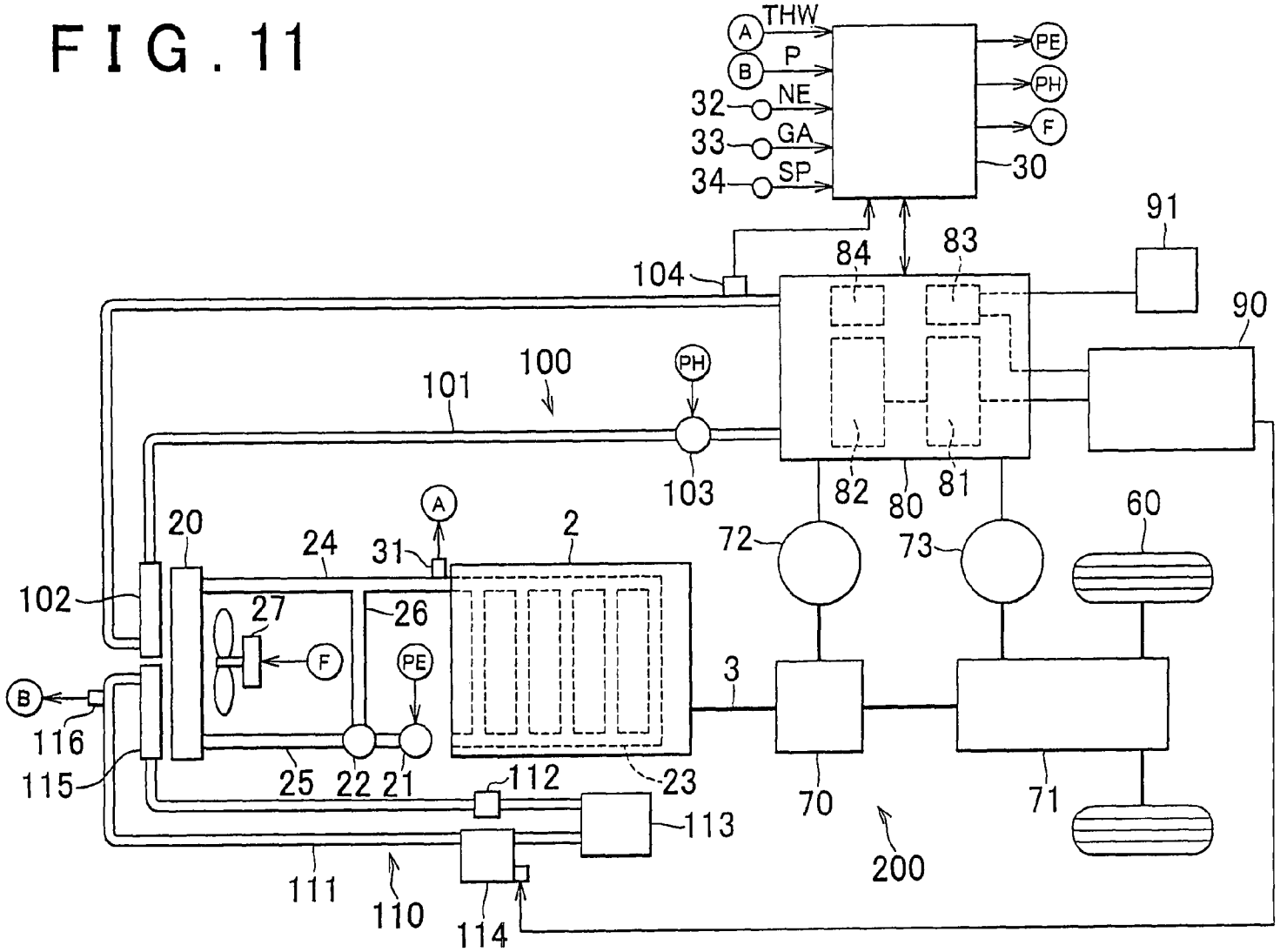
FIG. 11 is a schematic diagram showing a cooling apparatus according to a third embodiment, and a configuration around the cooling apparatus.

FIG. 11 is a schematic configuration diagram showing the cooling apparatus according to the third embodiment, and the configuration around the cooling apparatus. In FIG. 11, the same and corresponding members as those in FIG. 1 are denoted by the same reference numerals.

As shown in FIG. 11, the crankshaft 3 of the engine 2 provided in a vehicle 200 is connected to the input shaft of a power split mechanism 70. The output shaft of the power split mechanism 70 is connected to a speed reducer 71 and a generator 72 that is an electric power generator. The output from the engine 2 is distributed to the speed reducer 71 and the generator 72. The distribution ratio between the engine output distributed to the speed reducer 71 and the engine output distributed to the generator 72 is changed according to the engine operating state. The speed reducer 71 is connected to the wheels 60 of the vehicle 200. An electric motor 73 is connected to the speed reducer 71. The vehicle 200 is driven by the output from the engine 2 and the output from the electric motor 73.

The generator 72, the electric motor 73, a battery 90 for driving the vehicle (hereinafter, referred to as "vehicle drive battery"), and a battery 91 for auxiliary machine (hereinafter, referred to as "auxiliary machine battery") are connected to a power control unit (hereinafter, referred to as "PCU") 80. The vehicle drive battery 90 and the auxiliary machine battery 91 are storage batteries. The PCU 80 includes a converter 81, an inverter 82, a DC-DC converter 83, and an electric power control device 84 that controls the converters and the inverter. The voltage of the DC power of the vehicle drive battery 90 is increased by the converter 81, and then, the DC power is converted to the AC power by the inverter 82, and the AC power is supplied to the electric motor 73. The AC power generated by the generator 72 is converted to the DC power by the inverter 82, and then, the voltage of the DC power is decreased by the converter 81, and the DC power is stored in the vehicle drive battery 90. The voltage of the DC power of the vehicle drive battery 90 is reduced by the DC-DC converter 83, and then, the DC power is supplied to the auxiliary machine battery 91.

Heat is generated in the inverter 82 when the electric power to be supplied from the vehicle drive battery 90 to the electric motor 73 is converted from the DC power to the AC power. Therefore, an inverter cooling device 100, which cools the inverter 82, is provided in the PCU 80.

The inverter cooling device 100 includes an inverter pipe 101, an inverter radiator 102, and a water pump 103. An inverter coolant, which cools the inverter 82, flows through the inverter pipe 101. The inverter radiator 102 is disposed close to the radiator 20 for the engine 2, and connected to the inverter pipe 101. The water pump 103 is disposed in the inverter pipe 101 to circulate the inverter coolant. The inverter radiator 102 is cooled by wind or the electric fan 27. The water pump 103 is an electric water pump. The water pump 103 is constantly operated using the electric power of the auxiliary machine battery 91. A coolant sensor 104, which detects the temperature THI of the inverter coolant (hereinafter, referred to as "inverter coolant temperature"), is provided in the inverter pipe 101. The detection signal from the coolant sensor 104 is input to the control device 30 for the engine 2.

An air conditioning device 110, which adjusts the temperature and humidity of air in a vehicle cabin, is provided in the vehicle 200. The air conditioning device 110 includes a cooling medium pipe 111, an expansion valve 112, an evaporator 113, a compressor 114, and a condenser 115 provided close to the radiator 20 for the engine 2. In the air conditioning device 110, a liquid cooling medium with high temperature and high pressure, which is delivered from the condenser 115 to the expansion valve 112, is changed to the misty cooling medium with low temperature and low pressure when the cooling medium passes through the expansion valve 112. The misty cooling medium with low temperature and low pressure is evaporated by the evaporator 113. The temperature of air supplied to the vehicle cabin is decreased using the heat of evaporation. The evaporated cooling medium with low temperature and low pressure is changed to the evaporated cooling medium with high temperature and high pressure by the compressor 114. Then, the evaporated cooling medium with high temperature and high pressure is cooled by the condenser 115 so that the cooling medium is returned to the liquid cooling medium with high temperature and high pressure. The condenser 115 is also cooled by wind and the electric fan 27. A pressure sensor 116, which detects a discharge pressure P of the cooling medium, is provided downstream of the compressor 114. The detection signal from the pressure sensor 116 is input to the control device 30 for the engine 2. The compressor 114 in the third embodiment is operated by the electric motor, and the electric power of the vehicle drive battery 90 is used to operate the electric motor. However, the compressor 114 may be operated using the output from the engine 2.

Figure 12:
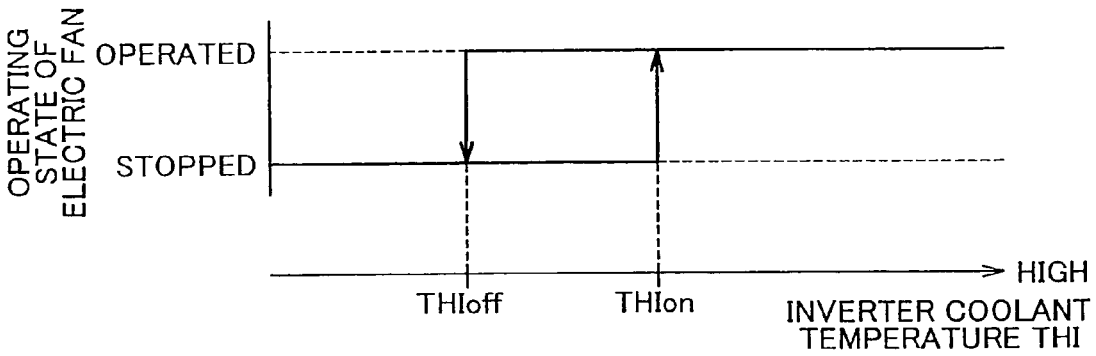
FIG. 12 is a schematic diagram showing the manner in which the electric fan is operated in the third embodiment.
Figure 13:
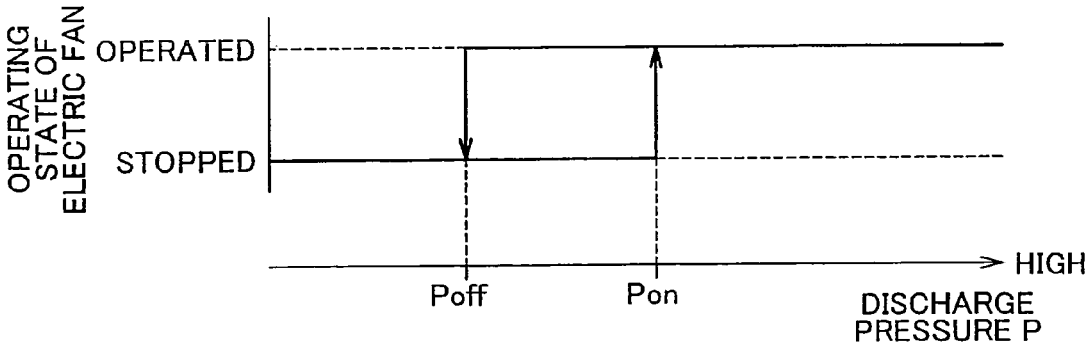
FIG. 13 is a schematic diagram showing the manner in which the electric fan is operated in the third embodiment.

The control device 30 controls the operation of the electric fan 27 according to the inverter coolant temperature THI, and according to the discharge pressure P, as well as according to the temperature THW of the coolant for the engine 2. For example, as shown in FIG. 12, when the inverter coolant temperature THI is equal to or higher than a predetermined fan operation temperature THIon, the electric fan 27 is operated to decrease the inverter coolant temperature THI. When the inverter coolant temperature THI is decreased to a fan stop temperature THIoff lower than the fan operation temperature THIon after the operation of the electric fan 27 is started, the operation of the electric fan 27 is stopped.

When the discharge pressure P is equal to or higher than a predetermined fan operation pressure Pon, the electric fan 27 is operated to promote the cooling of the cooling medium. When the discharge pressure P is reduced to a fan stop pressure Poff lower than the fan operation pressure Pon after the operation of the electric fan 27 is started, the operation of the electric fan 27 is stopped.

Thus, in the third embodiment, the operation of the electric fan 27 is controlled according to parameters (for example, the inverter coolant temperature THI and the discharge pressure P) that are different from the temperature THW of the coolant for the engine 2, as well as according to the coolant temperature THW. Accordingly, even if the discharge flow rate Vw of the electric water pump 21 is increased when the electric fan 27 is operated according to a request for operating the electric fan 27 based on the parameter different from the coolant temperature THW, the frequency of operating the electric fan 27 is not reduced, and rather, the consumed electric power may be increased due to the increase in the electric power for operating the electric water pump 21.

Accordingly, in the control of the operation of the electric water pump 21 in the third embodiment, when the electric fan 27 is operated according to the request for operating the electric fan 27 based on the parameter different from the coolant temperature THW, a predetermined value change control is executed to increase the above-described vehicle speed-based correction start temperature THsp as compared to when there is no request for operating the electric fan 27 based on the parameter different from the coolant temperature THW.

Figure 14:
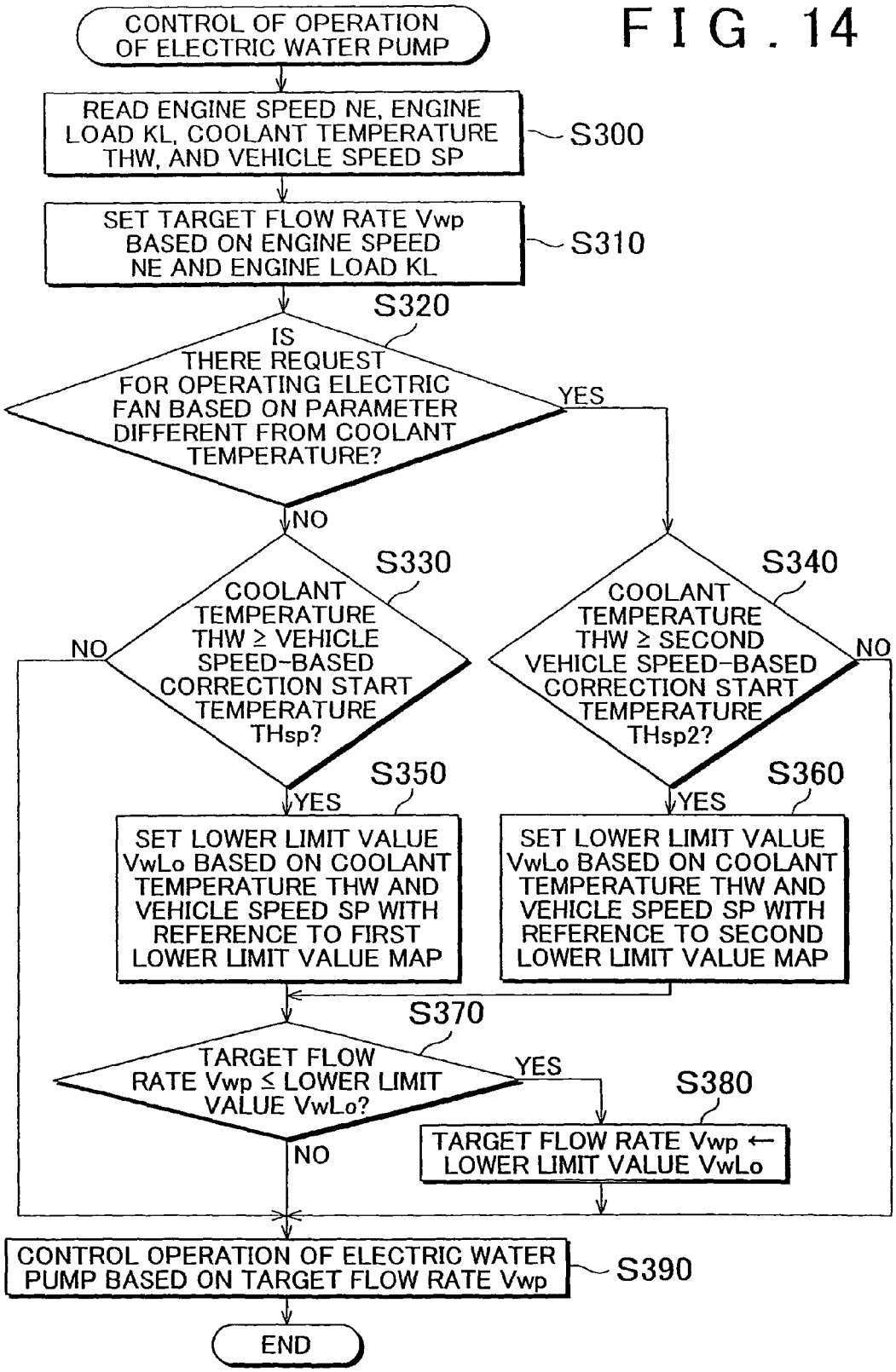
FIG. 14 is a flowchart showing the control of the operation of the electric water pump in the third embodiment.

FIG. 14 shows steps of the control of the operation of the electric water pump 21 in the third embodiment. The control is also repeatedly executed by the control device 30 at predetermined intervals. When the control is started, first, the engine speed NE, the engine load KL, the coolant temperature THW, and the vehicle speed SP are read (S300). In the third embodiment as well, the engine load KL is the ratio of the current intake air amount GA to the intake air amount at engine full load. However, for example, the engine load KL may be calculated based on the amount of fuel injected from the fuel injection valve, the opening degree of the throttle valve provided in the intake passage, or the operation amount of the accelerator pedal.

Next, the target flow rate Vwp of the electric water pump 21 is set based on the engine speed NE and the engine load KL (S310). The amount of heat generated in the engine 2 increases as the engine speed NE increases, and as the engine load KL increases. Therefore, the target flow rate Vwp is set to increase as the engine speed NE or the engine load KL increases.

Next, it is determined whether there is a request for operating the electric fan 27 based on the parameter different from the temperature THW of the coolant for the engine 2 (S320). When the electric fan 27 is operated based on the inverter coolant temperature THI or the discharge pressure P, it is determined that there is the request for operating the electric fan 27 based on the parameter different from the coolant temperature THW.

When there is no request for operating the electric fan 27 based on the parameter different from the coolant temperature THW (NO in step S320), the control of the operation of the electric water pump 21 is executed in the same manner as in the second embodiment. That is, when the coolant temperature. THW is lower than the vehicle speed-based correction start temperature THsp NO in step S330), the operation of the electric water pump 21 is controlled based on the target flow rate Vwp set in step S310 (S390). When it is determined that the coolant temperature THW is equal to or higher than the vehicle speed-based correction start temperature THsp in step S330 (YES in step S330), the lower limit value VwLo of the discharge flow rate Vw is set based on the coolant temperature THW and the vehicle speed SP, with reference to a first lower limit value map in which the same values as those in the lower limit value map shown in FIG. 7 are set (S350). Then, when the target flow rate Vwp is higher than the lower limit value VwLo (NO in step S370), the operation of the electric water pump 21 is controlled based on the target flow rate Vwp set in the previous step S310 (S390). Thus, the control is finished. When the target flow rate Vwp is equal to or lower than the lower limit value VwLo (YES in step S370), the target flow rate Vwp set in the previous step S310 is changed to the lower limit value VwLo (S380), and the operation of the electric water pump 21 is controlled based on the lower limit value VwLo (S390). Thus, the control is finished.

When there is the request for operating the electric fan 27 based on the parameter different from the coolant temperature THW (YES in step S320), the following processes are executed as the above-described predetermined value change control. First, it is determined whether the coolant temperature THW is equal to or higher than a second vehicle speed-based correction start temperature THsp2 (S340). The second vehicle speed-based correction start temperature THsp2 is set to be higher than the vehicle speed-based correction start temperature THsp. In the third embodiment, the second vehicle speed-based correction start temperature THsp2 is set to be higher than the fan stop temperature THoff, and lower than the fan operation temperature THon by a predetermined value β. However, the second vehicle speed-based correction start temperature THsp2 may be changed to other temperatures.

When the coolant temperature THW is lower than the second vehicle speed-based correction start temperature THsp2 (NO in step S340), the operation of the electric water pump 21 is controlled based on the target flow rate Vwp set in step S310 (S390).

Figure 15:
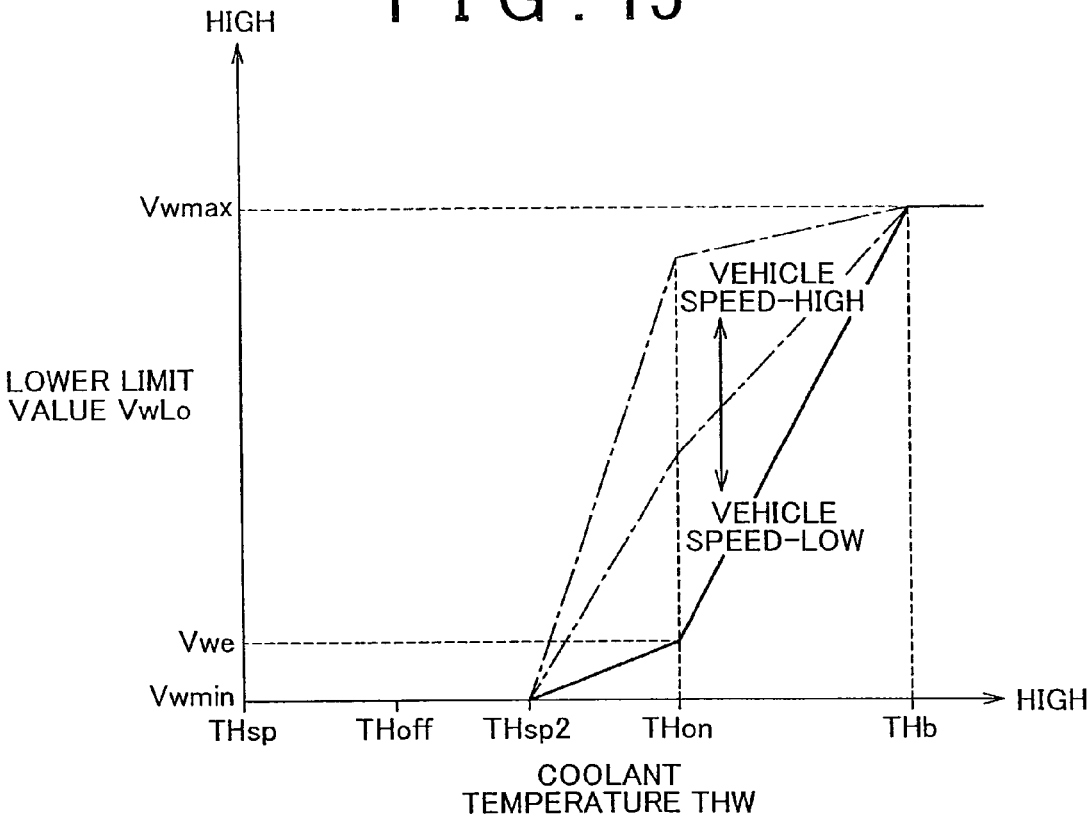
FIG. 15 is a graph showing the manner in which a second lower limit value map is set in the third embodiment.

When the coolant temperature THW is equal to or higher than the second vehicle speed-based correction start temperature THsp2 (YES in step S340), the lower limit value VwLo of the discharge flow rate Vw is set based on the coolant temperature THW and the vehicle speed SP, with reference to a second lower limit value map (S360). In step S360, the lower limit value VwLo is variably set based on the second lower limit value map stored in the memory of the control device 30. More specifically, as shown in FIG. 15, when the coolant temperature THW is equal to the second vehicle speed-based correction start temperature THsp2, the lower limit value VwLo is set to the minimum discharge flow rate Vwmin of the electric water pump 21. When the coolant temperature THW is higher than the second vehicle speed-based correction start temperature THsp2, the lower limit value VwLo is increased in accordance with the increase in the coolant temperature THW. When the coolant temperature THW reaches the fan operation temperature THon, the lower limit value VwLo is set to the efficient flow rate Vwe set based on the vehicle speed SP. When the coolant temperature THW is higher than the fan operation temperature THon, the lower limit value VwLo is increased again in accordance with the increase in the coolant temperature THW. When the coolant temperature THW is equal to or higher than the above-described maximum required radiation temperature THb, the lower limit value VwLo is set to the maximum discharge flow rate Vwmax of the electric water pump 21. The values of the efficient flow rate Vwe set in the second lower limit value map are the same as the values of the efficient flow rate Vwe in the second embodiment. As shown in FIG. 9, the efficient flow rate Vwe is set to increase as the vehicle speed SP increases. Accordingly, as shown by the chain line in FIG. 15, when the coolant temperature is in a range above the second vehicle speed-based correction start temperature THsp2 and below the maximum required radiation temperature THb, the lower limit value VwLo is increased as the vehicle speed SP increases, even if the coolant temperature THW remains the same. Thus, in the second lower limit value map as well, the lower limit value VwLo is variably set so that the lower limit value VwLo is increased as the coolant temperature THW increases, and as the vehicle speed SP increases.

After the lower limit value VwLo is set in step S360, it is determined whether the target flow rate Vwp is equal to or lower than the lower limit value VwLo (S370). When the target flow rate Vwp is higher than the lower limit value VwLo (NO in step S370), the operation of the electric water pump 21 is controlled based on the target flow rate Vwp set in the previous step S310 (S390). Thus, the control is finished.

When the target flow rate Vwp is equal to or lower than the lower limit value VwLo set in step S360 (YES in step S370), the target flow rate Vwp set in the previous step S310 is changed to the lower limit value VwLo set in step S360 (S380). Then, the operation of the electric water pump 21 is controlled based on the target flow rate Vwp that is changed to the lower limit value VwLo, that is, the operation of the electric water pump 21 is actually controlled based on the lower limit value VwLo set in step S360 (S390). Thus, the control is finished.

Figure 16:
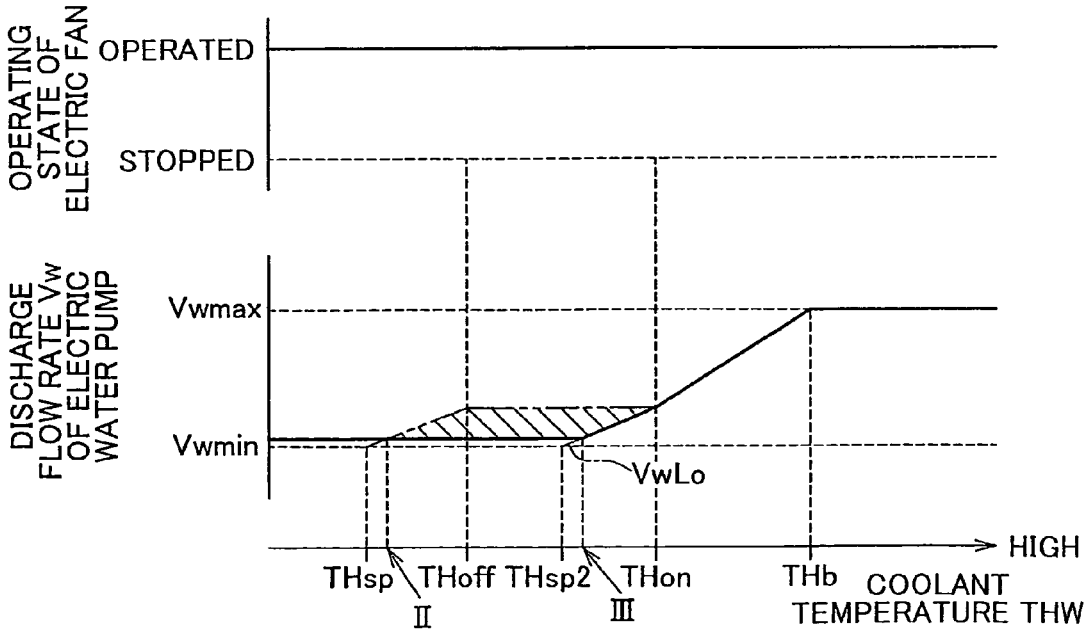
FIG. 16 is a timing chart showing the effect of the control of the operation of the electric water pump in the third embodiment.

FIG. 16 shows the effect of the above-described control of the operation of the electric water pump 21 when the electric fan 27 is operated according to the request for operating the electric fan 27 based on the parameter different from the temperature THW of the coolant for the engine 2. The two-dot chain line in FIG. 16 shows a change in the discharge flow rate Vw when the predetermined value change control is not executed, in other words, a change in the discharge flow rate Vw when the control of the operation of the electric water pump 21 in the second embodiment is executed.

In the case where the control of the operation of the electric water pump 21 in the third embodiment is executed, when the coolant temperature THW is lower than the second vehicle speed-based correction start temperature THsp2, the operation of the electric water pump 21 is controlled based on the target flow rate Vwp set based on the amount of heat generated in the engine 2. When the coolant temperature THW reaches the second vehicle speed-based correction start temperature THsp2, the setting of the lower limit value VwLo is started. As the coolant temperature THW increases, the lower limit value VwLo is gradually increased. The target flow rate Vwp is equal to the lower limit valve VwLo at timing III, and the target flow rate Vwp is lower than the lower limit value VwLo after timing III. Thus, after timing III, the operation of the electric water pump 21 is controlled based on the lower limit value VwLo. More specifically, the discharge flow rate Vw of the electric water pump 21 is gradually increased in accordance with the increase in the lower limit value VwLo due to the increase in the coolant temperature THW. When the coolant temperature THW reaches the fan operation temperature THon, the lower limit value VwLo is set to the efficient flow rate Vwe, and therefore, the discharge flow rate Vw is also adjusted to the efficient flow rate Vwe.

When the coolant temperature THW is higher than the fan operation temperature THon, the discharge flow rate Vw is gradually increased from the efficient flow rate Vwe as the coolant temperature THW increases. After the coolant temperature THW reaches the maximum required radiation temperature THb, the discharge flow rate Vw is adjusted to the maximum discharge flow rate Vwmax.

In the case where the predetermined value change control is not executed, the setting of the lower limit value VwLo is started at the time point at which the coolant temperature THW reaches the vehicle speed-based correction start temperature THsp that is lower than the second vehicle speed-based correction start temperature THsp2. As the coolant temperature THW increases, the lower limit value VwLo is gradually increased. The target flow rate Vwp reaches the lower limit valve VwLo at timing II, and the target flow rate Vwp is lower than the lower limit value VwLo after timing II. Thus, after timing II, the discharge flow rate Vw of the electric water pump 21 is increased in accordance with the increase in the lower limit value VwLo due to the increase in the coolant temperature THW. Thus, in the case where the predetermined value change control is not executed, the discharge flow rate Vw starts to be increased at the low coolant temperature THW, as compared to the case where the predetermined value change control is executed. As described above, even if the discharge flow rate Vw of the electric water pump 21 is increased when the electric fan 27 is operated according to the request for operating the electric fan 27 based on the parameter different from the temperature THW of the coolant for the engine 2, the frequency of operating the electric fan 27 is not reduced, and rather, the consumed electric power may be increased due to the increase in the electric power for operating the electric water pump 21.

Thus, in the control of the operation of the electric water pump 21 in the third embodiment, the discharge flow rate Vw starts to be increased when the temperature THW of the coolant for the engine 2 is high, as compared to the control of the operation of the electric water pump 21 in the second embodiment. Therefore, it is possible to minimize the unnecessary increase in the electric power for the electric water pump 21, which does not contribute to the reduction of the frequency of operating the electric fan 27. Thus, it is possible to suppress the increase in the electric power consumed by the electric water pump 21 (the electric power equivalent to the hatched area in the example shown in FIG. 16) when the coolant temperature THW is low, as compared to the control of the operation of the electric water pump 21 in the second embodiment.

The increase in the electric power consumed by the electric water pump 21 may be suppressed by prohibiting the increase in the discharge flow rate Vw when the electric fan 27 is operated according to the request for operating the electric fan 27 based on the parameter different from the temperature THW of the coolant for the engine 2. However, in the third embodiment, the increase in the coolant temperature THW is suppressed by starting to increase the discharge flow rate Vw at the time point at which the coolant temperature THW exceeds the second vehicle speed-based correction start temperature THsp2.

As described above, in the third embodiment, it is possible to obtain the following advantageous effects, as compared to the case where the control of the operation of the electric water pump 21 in the second embodiment is applied to the cooling apparatus in the vehicle 200.

(6) In the vehicle 200, the electric fan 27 is operated according to the requests for operating the electric fan 27 based on the parameters (for example, the inverter coolant temperature THI and the discharge pressure P of the compressor 114) that are different from the temperature THW of the coolant for the engine 2, as well as according to the request based on the coolant temperature THW. When the electric fan 27 is operated according to the request for operating the electric fan 27 based on the parameter different from the coolant temperature THW, the discharge flow rate Vw starts to be increased at the high coolant temperature THW, as compared to when there is no request for operating the electric fan 27 based on the parameter different from the coolant temperature THW. Accordingly, it is possible to minimize the unnecessary increase in the electric power for the electric water pump 21, which does not contribute to the reduction of the frequency of operating the electric fan 27. Thus, it is possible to suppress the increase in the electric power consumed by the electric water pump 21 when the coolant temperature THW is low, as compared to the case where the predetermined value change control is not executed.

Fourth Embodiment

Next, a cooling apparatus for an internal combustion engine according to a fourth embodiment of the invention will be described with reference to FIG. 17 to FIG. 19, focusing on differences between the third embodiment and the fourth embodiment.

In the third embodiment, the electric fan 27 is stopped or operated. When the electric fan 27 is operated, the amount of air is constant. In contrast, in the fourth embodiment, when the electric fan 27 is operated, the rotational speed is changed between two levels, that is, the operating state of the electric fan 27 is changed between "a low-speed mode" and "a high-speed mode". When the electric fan 27 is in the high-speed mode, the electric fan 27 is operated at the highest rotational speed. Thus, the amount of air is variable.

Figure 17:
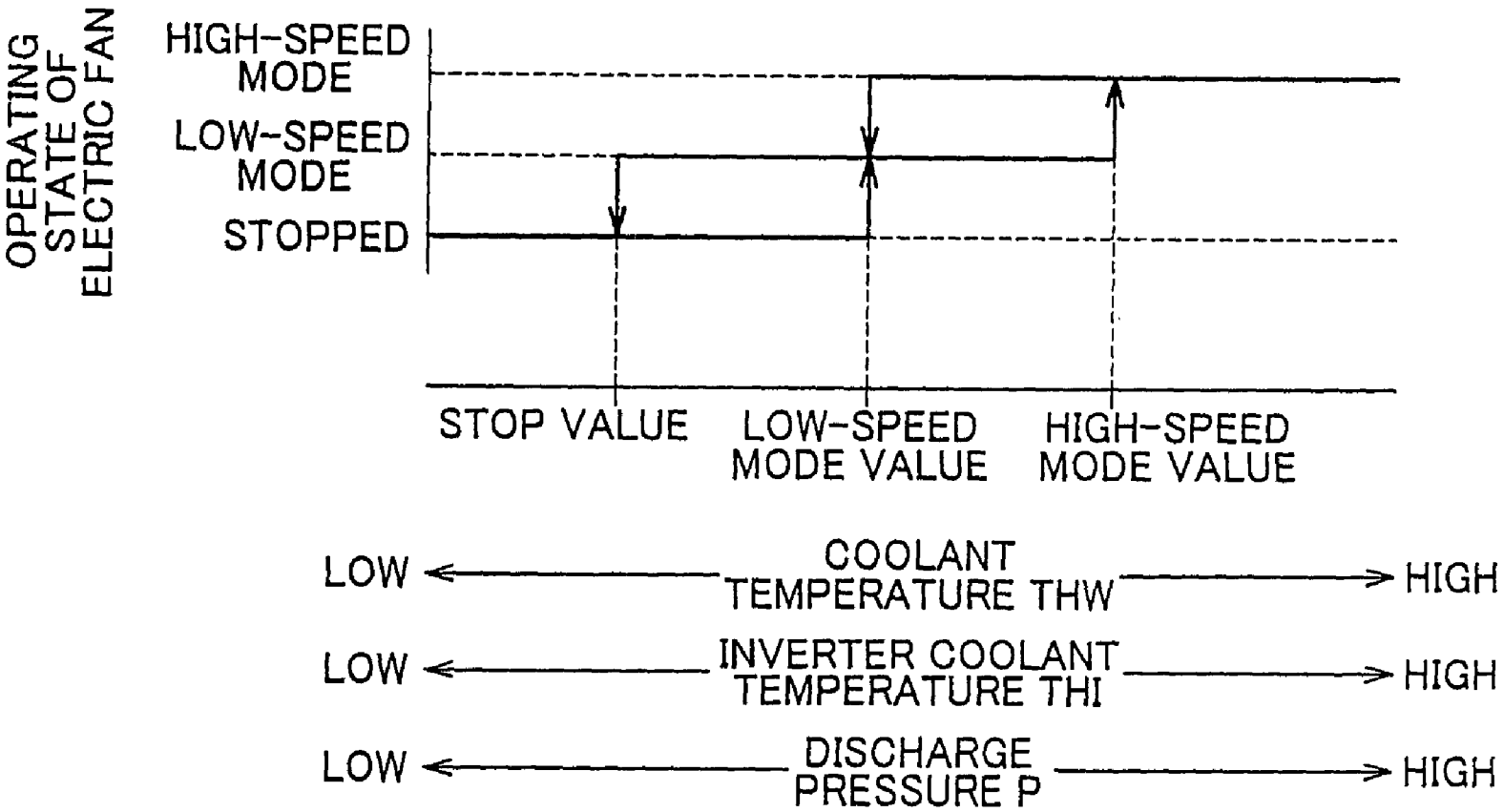
FIG. 17 is a schematic diagram showing the manner in which the electric fan is operated in a fourth embodiment.

More specifically, as shown in FIG. 17, for example, when one of the parameters (the coolant temperature THW, the inverter coolant temperature THI, and the discharge pressure P of the compressor 114) increases, and the one of the parameters is equal to or higher than a low-speed mode value that is appropriately set, a request for operating the electric fan 27 at low speed is made. Thus, the operating state of the electric fan 27 is switched from "a stopped state" to "the low-speed mode". When one of the parameters is equal to or higher than a high-speed mode value that is set to be higher than the low-speed mode value, a request for operating the electric fan 27 at high speed is made. Thus, the operating state of the electric fan 27 is switched from "the low-speed mode" to "the high-speed mode", and the amount of air is increased. For example, when one of the parameters (the coolant temperature THW, the inverter coolant temperature THI, and the discharge pressure P of the compressor 114) decreases, and all the parameters are lower than respective values that are appropriately set, the operating state of the electric fan 27 is switched from "the high-speed mode" to "the low-speed mode". When all the parameters are lower than respective other values that are appropriately set, the operating state of the electric fan 27 is switched from "the low-speed mode" to "the stopped state". Thus, the amount of air sequentially is decreased.

Figure 18:
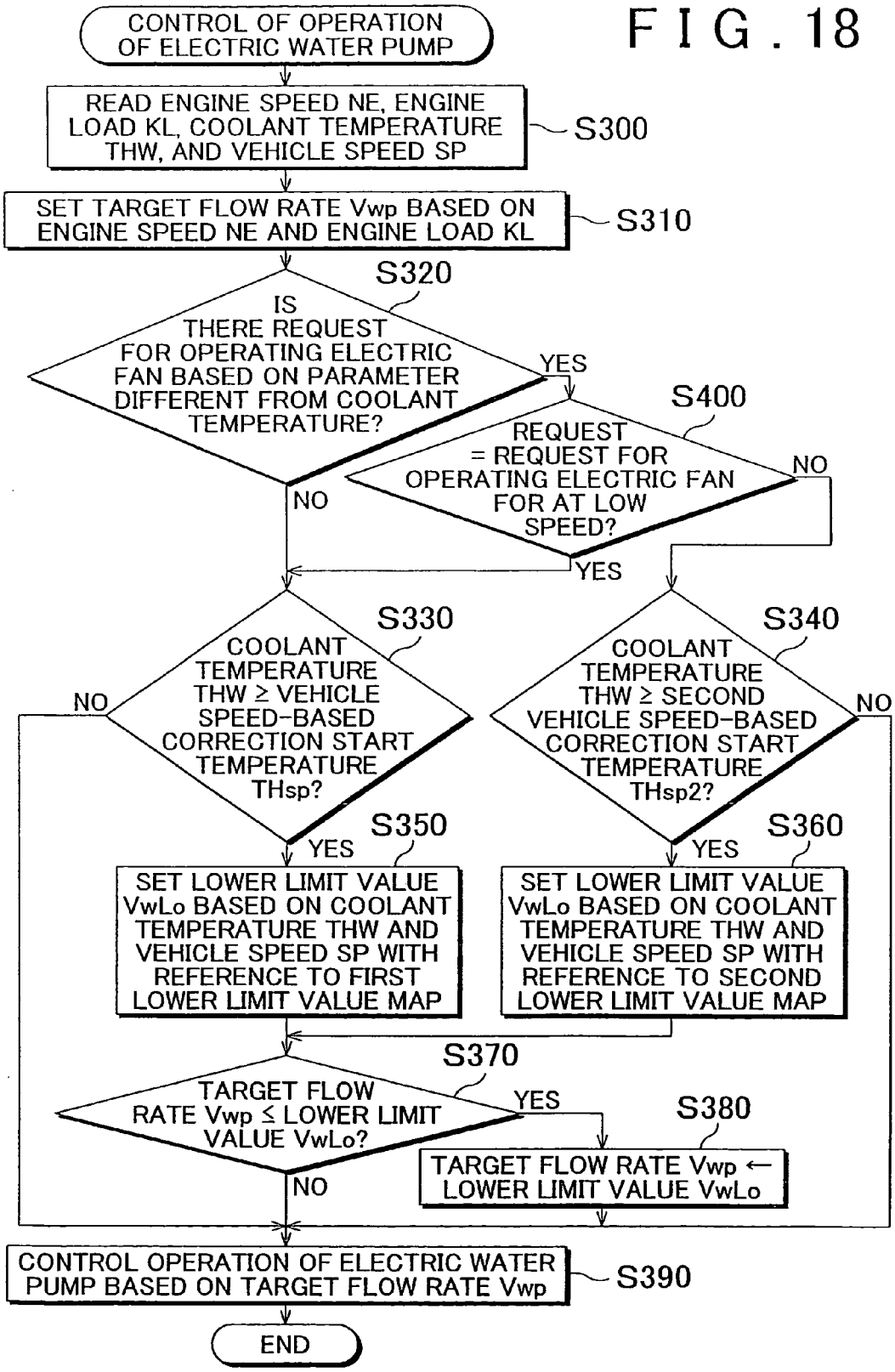
FIG. 18 is a flowchart showing the control of the operation of the electric water pump in the fourth embodiment.
Figure 19:
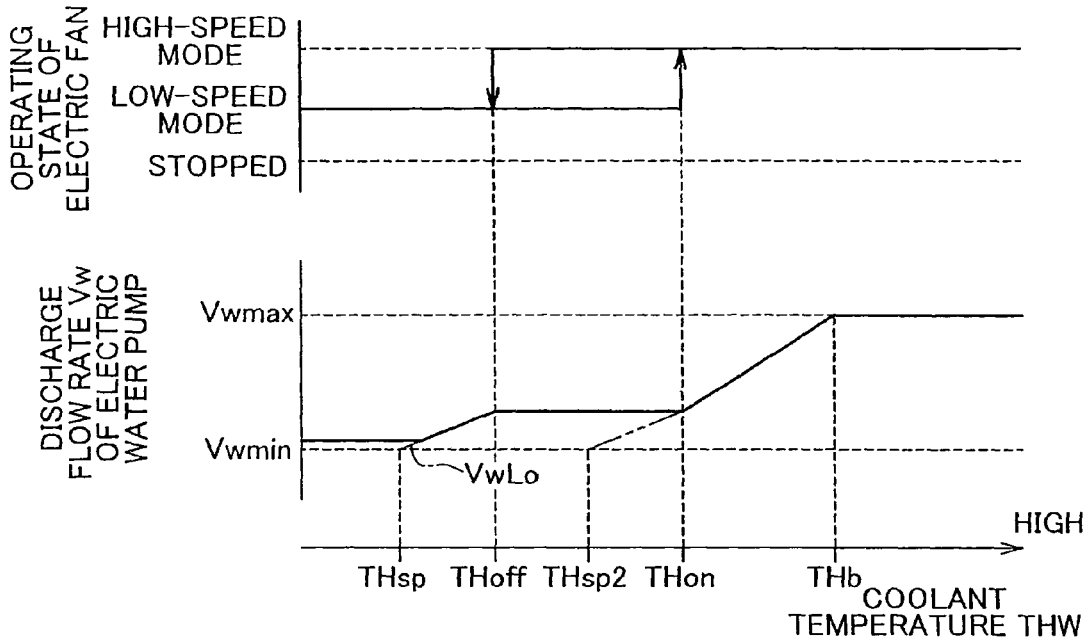
FIG. 19 is a timing chart showing the effect of the control of the operation of the electric water pump in the fourth embodiment.

In the fourth embodiment, a process in step S400 shown in FIG. 18 is added to the control of the operation of the electric water pump 21 in the third embodiment, in order to appropriately execute the control of the operation of the electric water pump 21 in combination with the control that changes the amount of air of the electric fan 27.

Hereinafter, the control of the operation of the electric water pump 21 in the fourth embodiment will be described with reference to steps of the control shown in FIG. 18. The control is also repeatedly executed by the control device 30 at predetermined intervals. In FIG. 18, the same processes as those in FIG. 14 are denoted by the same step numbers.

When the control is started, the engine speed NE, the engine load KL, the coolant temperature THW, and the vehicle speed SP are read (S300). Next, the target flow rate Vwp of the electric water pump 21 is set based on the engine speed NE and the engine load KL (S310).

Next, it is determined whether there is the request for operating the electric fan 27 based on the parameter different from the temperature THW of the coolant for the engine 2 (S320). In this step as well, when the electric fan 27 is operated based on the inverter coolant temperature THI or the discharge pressure P, it is determined that there is the request for operating the electric fan 27 based on the parameter different from the coolant temperature THW.

When there is no request for operating the electric fan 27 based on the parameter different from the coolant temperature THW (NO in step S320), the control of the operation of the electric water pump 21 is executed in the same manner as in the second embodiment. That is, when it is determined that the coolant temperature THW is lower than the vehicle speed-based correction start temperature THsp (NO in step S330), the operation of the electric water pump 21 is controlled based on the target flow rate Vwp set in step S310 (S390). When it is determined that the coolant temperature THW is equal to or higher than the vehicle speed-based correction start temperature THsp in step S330 (YES in step S330), the lower limit value VwLo of the discharge flow rate Vw is set based on the coolant temperature THW and the vehicle speed SP, with reference to the first lower limit value map in which the same values as those in the lower limit value map in FIG. 7 are set (S350). When the target flow rate Vwp is higher than the lower limit value VwLo (NO in step S370), the operation of the electric water pump 21 is controlled based on the target flow rate Vwp set in the previous step S310 (S390). Thus, the control is finished. When the target flow rate Vwp is equal to or lower than the lower limit value VwLo (YES in step S370), the target flow rate Vwp, which is set in the previous step S310, is changed to the lower limit value VwLo (S380). Then, the operation of the electric water pump 21 is controlled based on the lower limit value VwLo (S390). Thus, the control is finished.

When it is determined that there is the request for operating the electric fan 27 based on the parameter different from the coolant temperature THW in step S320, (YES in step S320), it is determined whether the request is the request for operating the electric fan 27 at low speed (S400).

When the request is the request for operating the electric fan 27 at low speed (YES in step S400), the control is executed in the same manner as the control executed when it is determined that there is no request for operating the electric fan 27 based on the parameter different from the coolant temperature THW (NO in step S320). That is, the control of the operation of the electric water pump 21 is executed in the same manner as in the second embodiment, without executing the above-described predetermined value change control. Thus, when the coolant temperature THW is equal to or higher than the vehicle speed-based correction start temperature THsp, the setting of the lower limit value VwLo is started using the first lower limit value map. As the coolant temperature THW increases, and as the vehicle speed SP increases, the lower limit value VwLo is increased, and therefore, the discharge flow rate Vw of the electric water pump 21 is increased.

When the request is not the request for operating the electric fan 27 at low speed (NO in step S400), it is determined that there is the request for operating the electric fan 27 at high speed. This situation is the same as the situation where "there is the request for operating the electric fan 27 based on the parameter different from the temperature THW of the coolant for the engine 2" in the third embodiment. Thus, in the fourth embodiment as well, processes in step S340 and subsequent steps are sequentially executed, to execute the predetermined value change control as in the third embodiment. Thus, when the coolant temperature THW is equal to or higher than the second vehicle speed-based correction start temperature THsp2 that is higher than the vehicle speed-based correction start temperature THsp, the setting of the lower limit value VwLo is started using the second lower limit value map.

In the fourth embodiment, the above-described control of the operation of the electric fan 27 is executed. Thus, when there is no request for operating the electric fan 27 based on the parameter different from the temperature THW of the coolant for the engine 2, it is possible to obtain the same advantageous effects as those obtained in the second embodiment. Also, when there is the request for operating the electric fan 27 based on the parameter different from the coolant temperature THW, and the request is the request for operating the electric fan 27 at high speed, it is possible to obtain the same advantageous effects as those obtained in the third embodiment.

When there is the request for operating the electric fan 27 based on the parameter different from the temperature THW of the coolant for the engine 2, and the request is the request for operating the electric fan 27 at low speed, it is possible to obtain the following advantageous effects. When the electric fan 27 is operated in the low-speed mode according to the request for operating the electric fan 27 based on the parameter different from the temperature THW of the coolant for the engine 2, and the discharge flow rate Vw is not increased, the coolant temperature THW increases and reaches the high-speed mode value. Then the operating state of the electric fan 27 is switched from the low-speed mode to the high-speed mode, and the electric power consumed by the electric fan 27 increases. On the other hand, in the control of the operation of the electric water pump 21 in the fourth embodiment, when the electric fan 27 is operated in the low-speed mode according to the request for operating the electric fan 27 based on the parameter different from the temperature THW of the coolant for the engine 2, the discharge flow rate Vw is increased without executing the above-described predetermined value change control. Therefore, as shown in FIG. 19, as compared to the case where the predetermined value change control is executed (as shown by the two-dot chain line in FIG. 19), the discharge flow rate Vw starts to be increased at the low coolant temperature THW. Thus, it is possible to increase the efficiency of cooling the coolant when the electric fan 27 is operated in the low-speed mode. As a result, the increase in the coolant temperature THW is suppressed. This suppresses the switching of the operating state of the electric fan 27 from the low-speed mode to the high-speed mode due to the increase in the coolant temperature THW. Accordingly, it is possible to suppress the increase in the electric power consumed by the electric fan 27.

As described above, according to the fourth embodiment, it is possible to further obtain the following advantageous effects, as compared to the third embodiment.

(7) When the electric fan 27 is operated according to the request for operating the electric fan 27 based on the parameter different from the temperature THW of the coolant for the engine 2, and the rotational speed of the electric fan 27 is equal to or lower than the predetermined value, that is, the electric fan 27 is operated in the low-speed mode, the discharge flow rate Vw is corrected without executing the above-described predetermined value change control. Thus, it is possible to increase the efficiency of cooling the coolant when the electric fan 27 is operated in the low-speed mode. As a result, the increase in the coolant temperature THW is suppressed. This suppresses the increase in the rotational speed of the electric fan 27 due to the increase in the coolant temperature THW. Accordingly, it is possible to suppress the increase in the electric power consumed by the electric fan 27.

The invention may be realized by modifying each of the above-described embodiments in the manners described below. In each of the embodiments, the discharge flow rate Vw is adjusted by changing the duty ratio of the electric power supplied to the electric water pump 21. However, the discharge flow rate Vw may be adjusted by changing the voltage or the electric current supplied to the electric water pump 21.

Figure 20:
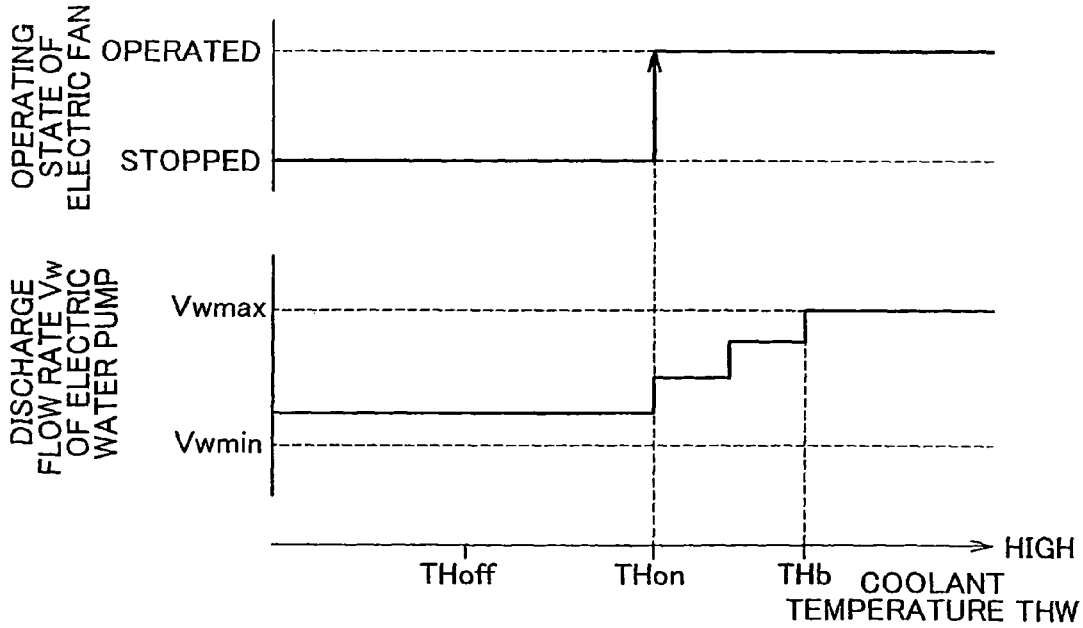
FIG. 20 is a timing chart showing a change in the discharge flow rate of the electric water pump in a modified example of the first embodiment.
Figure 21:
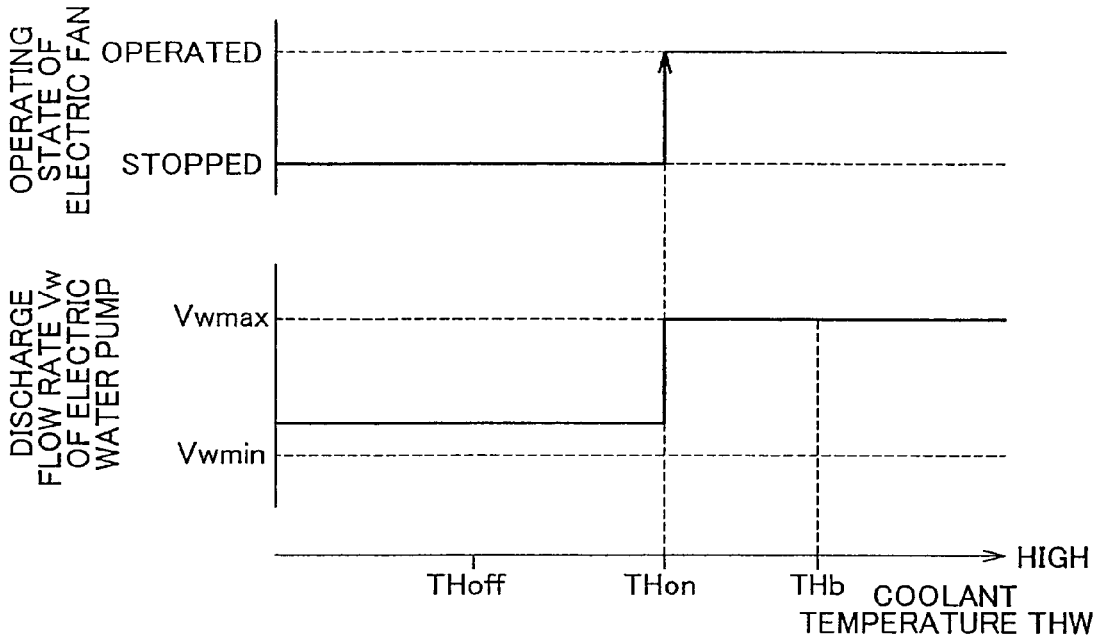
FIG. 21 is a timing chart showing a change in the discharge flow rate of the electric water pump in another modified example of the first embodiment.

In the first embodiment, when the discharge flow rate Vw is increased in accordance with the increase in the coolant temperature THW, the discharge flow rate Vw is gradually increased in proportion to the increase in the coolant temperature THW. In addition, the discharge flow rate Vw may be increased in a stepwise manner in accordance with the increase in the coolant temperature THW as shown in FIG. 20. The discharge flow rate Vw may be sharply increased to a certain value (for example, the maximum discharge flow rate Vwmax) at the time point at which the coolant temperature THW reaches the fan operation temperature THon), as shown in FIG. 21. In these cases as well, the flow rate of the coolant supplied to the radiator 20 is increased when the electric fan 27 is operated. Therefore, the discharge flow rate Vw is increased when the level of the radiation performance of the radiator 20 is high. Accordingly, it is possible to increase the level of the cooling performance, without wasting the electric power for driving the electric water pump 21 increased by increasing the operation duty D. Thus, the operation of the electric water pump 21 and the operation of the electric fan 27 are appropriately controlled.

In the second embodiment, the discharge flow rate Vw is corrected based on the vehicle speed SP. The efficiency of cooling the coolant is increased by increasing the discharge flow rate Vw of the electric water pump 21. Therefore, when the operation time of the electric fan 27 (i.e., the elapsed time after the operation of the electric fan 27 is started) is long, the decrease in the coolant temperature THW can be promoted, and thus, the electric fan 27 can be more quickly stopped, by increasing the discharge flow rate Vw. Accordingly, the discharge flow rate Vw may be corrected based on the operation time of the electric fan 27. In this case, the electric fan 27 can be more quickly stopped after the operation of the electric fan 27 is started. Thus, it is possible to suppress the increase in the electric power consumed by the electric fan 27. The process of correcting the discharge flow rate Vw based on the operation time constitutes the third flow rate correction means.

Figure 22:
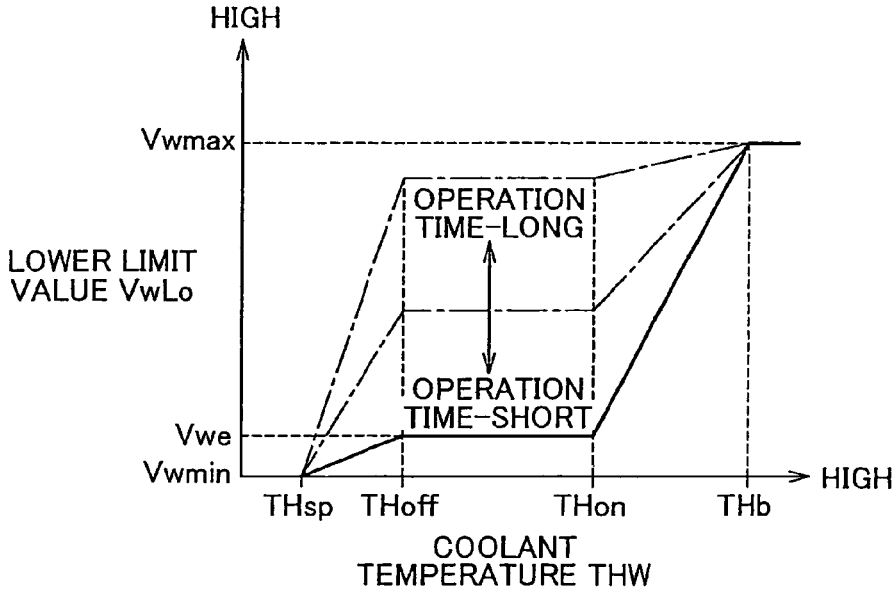
FIG. 22 is a graph showing the manner in which a lower limit value map is set in a modified example of the second embodiment.

When the discharge flow rate Vw is corrected based on the operation time, the target flow rate Vwp, which is set based on the amount of heat generated in the engine 2, may be directly corrected using a correction value set based on the operation time of the electric fan 27. However, in this case, when the amount of heat generated in the engine 2 is small, the target flow rate Vwp, which should be corrected, is low. Therefore, in this case, even if the target flow rate Vwp is corrected using the correction value, the discharge flow rate Vw may not be increased enough to reduce the operation time. Therefore, in this modified example as well, the lower limit value VwLo of the discharge flow rate Vw is set based on the operation time. When the target flow rate Vwp is equal to or lower than the lower limit value VwLo, the target flow rate Vwp is set to the lower limit value VwLo. By setting the lower limit value VwLo, the minimum value of the discharge flow rate Vw of the electric water pump 21 is limited by at least the lower limit value VwLo set based on the operation time. This reliably increases the discharge flow rate Vw. When the lower limit value VwLo is set in the modified example, the vehicle speed SP, which is the parameter used to set the lower limit value in the lower limit value map in FIG. 7, is changed to the operation time of the electric fan 27 as shown in FIG. 22. The lower limit value VwLo is variably set so that the discharge flow rate Vw is increased as the operation time increases. Thus, it is possible to appropriately correct the discharge flow rate Vw based on the operation time.

In the third embodiment, when the electric fan 27 is operated according to the request for operating the electric fan 27 based on the parameter different from the temperature THW of the coolant for the engine 2, the lower limit value VwLo is set using the second lower limit value map. However, the lower limit value VwLo may be set using the first lower limit value map. In this case, the lower limit value VwLo when the coolant temperature THW reaches the second vehicle speed-based correction start temperature THsp2 is set to the efficient flow rate Vwe, instead of the minimum discharge flow rate Vwmin. The lower limit value VwLo is maintained at the efficient flow rate Vwe until the coolant temperature THW reaches the fan operation temperature THon. In this modified example as well, it is possible to obtain the advantageous effects similar to those obtained in the third embodiment.

In each of the third and fourth embodiments, the parameters that are used to control the operation of the electric fan 27, and that are different from the temperature THW of the coolant for the engine 2 are the inverter coolant temperature THI and the discharge pressure P. In the case where the operation of the electric fan 27 is controlled based on a parameter other than the above-described parameters, by executing the control of the operation of the electric water pump 21 in the same manner as in each of the third embodiment and the fourth embodiment, it is possible to obtain the advantageous effects similar to those obtained in each of the third embodiment and the fourth embodiment.

In the fourth embodiment, the rotational speed of the electric fan 27 is changed between the two levels. In addition, the rotational speed of the electric fan 27 may be changed between three or more levels, or may be continuously changed. In these cases, when the rotational speed of the electric fan 27 is equal to or lower than a preset value; the control of the operation of the electric water pump 21 is executed in the same manner as the manner in which the control of the operation of the electric water pump 21 is executed when the electric fan 27 is operated in the low-speed mode. In these modified examples as well, it is possible to obtain the advantageous effects similar to those obtained in the fourth embodiment.

When the electric fan 27 is operated, the amount of air passing through the radiator 20 is increased, and the level of the radiation performance of the radiator 20 is increased, as compared to when the electric fan 27 is not operated. Accordingly, although the discharge flow rate Vw is corrected based on the vehicle speed SP in the second embodiment, the discharge flow rate Vw, which is corrected based on the vehicle speed SP, may be increased when the operation of the electric fan 27 is operated in the second embodiment. In this case, the discharge flow rate Vw of the electric water pump 21 is changed according to the level of the radiation performance of the radiator 20 that is changed according to the operating state of the electric fan 27, as well as according to the vehicle speed SP. Thus, it is possible to further increase the cooling efficiency when the electric fan 27 is operated. Accordingly, it is possible to further increase the level of the cooling performance, while effectively using the electric power supplied to the electric water pump 21.

Because the level of the cooling performance is increased in the above-described manner, the decrease in the coolant temperature THW is promoted when the electric fan 27 is operated. Therefore, the time required to decrease the coolant temperature THW to the fan stop temperature THoff is reduced, and accordingly, the operation time of the electric fan 27 is reduced. Because the operation of the electric fan 27 is more quickly stopped, it is also possible to suppress the increase in the electric power consumed by operating the electric fan 27.

Figure 23:
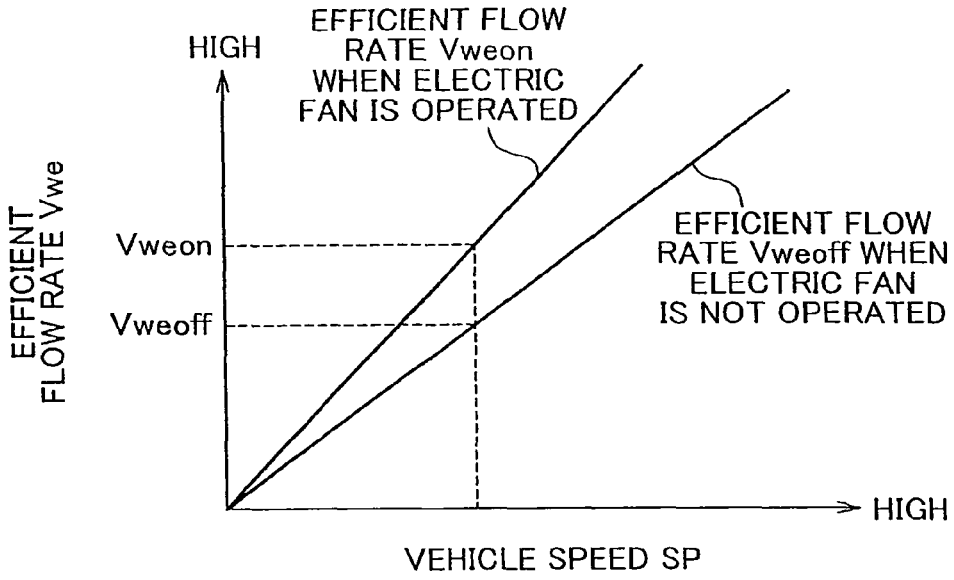
FIG. 23 is a graph showing a relation between the vehicle speed and the efficient flow rate when the electric fan is operated, and a relation between the vehicle speed and the efficient flow rate when the electric fan is stopped, in the modified example of the second embodiment.

Another modified example will be described. As shown in FIG. 23, the efficient flow rate Vwe when the electric fan 27 is operated (i.e., the operated time efficient flow rate Vweon in FIG. 23) is higher than the efficient flow rate Vwe when the electric fan 27 is not operated (i.e., the non-operated time efficient flow rate Vweoff in FIG. 23), even if the vehicle speed remains the same. Accordingly, for example, in the above-described lower limit value map, as the efficient flow rate Vwe corresponding to the vehicle speed SP, the operated time efficient flow rate Vweon and the non-operated time efficient flow rate Vweoff are set. The lower limit value VwLo is increased as the vehicle speed SP increases. Also, the lower limit value VwLo when the electric fan 27 is operated is higher than the lower limit value VwLo when the electric fan 27 is not operated, even if the vehicle speed remains the same.

Figure 24:
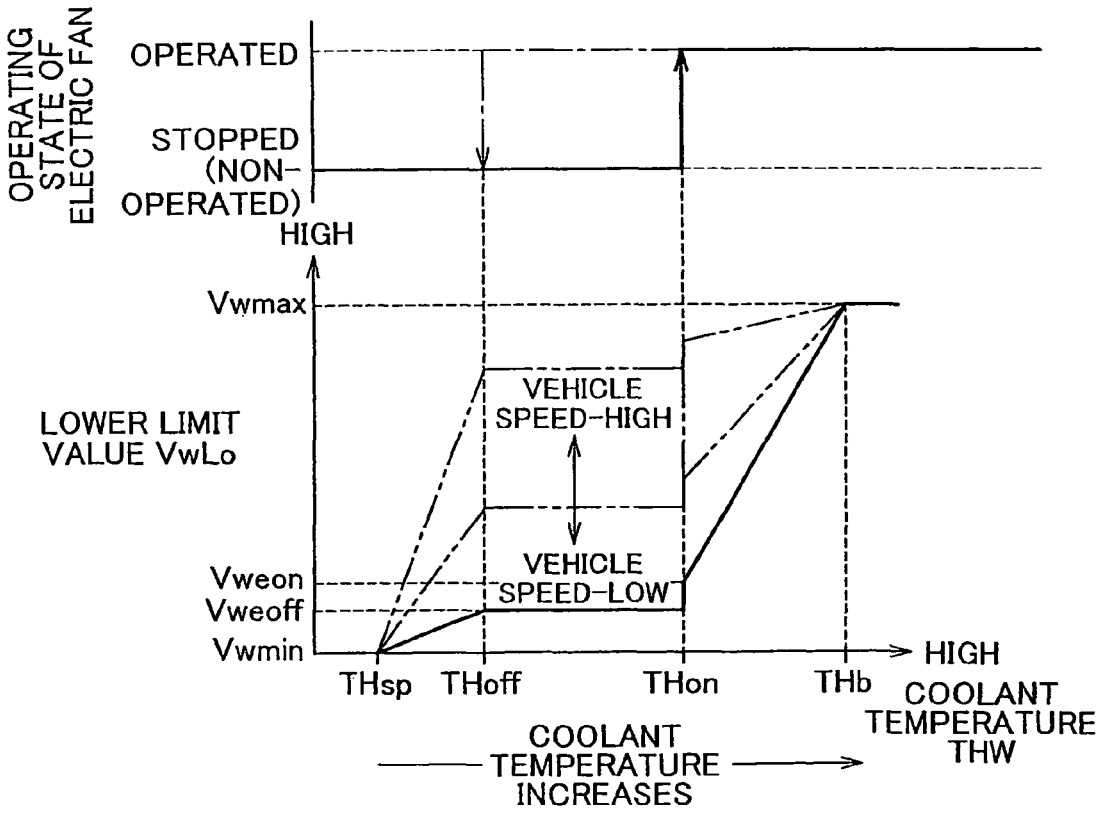
FIG. 24 is a graph showing the manner in which the lower limit value is changed when a coolant temperature increases, in the modified example of the second embodiment.
Figure 25:
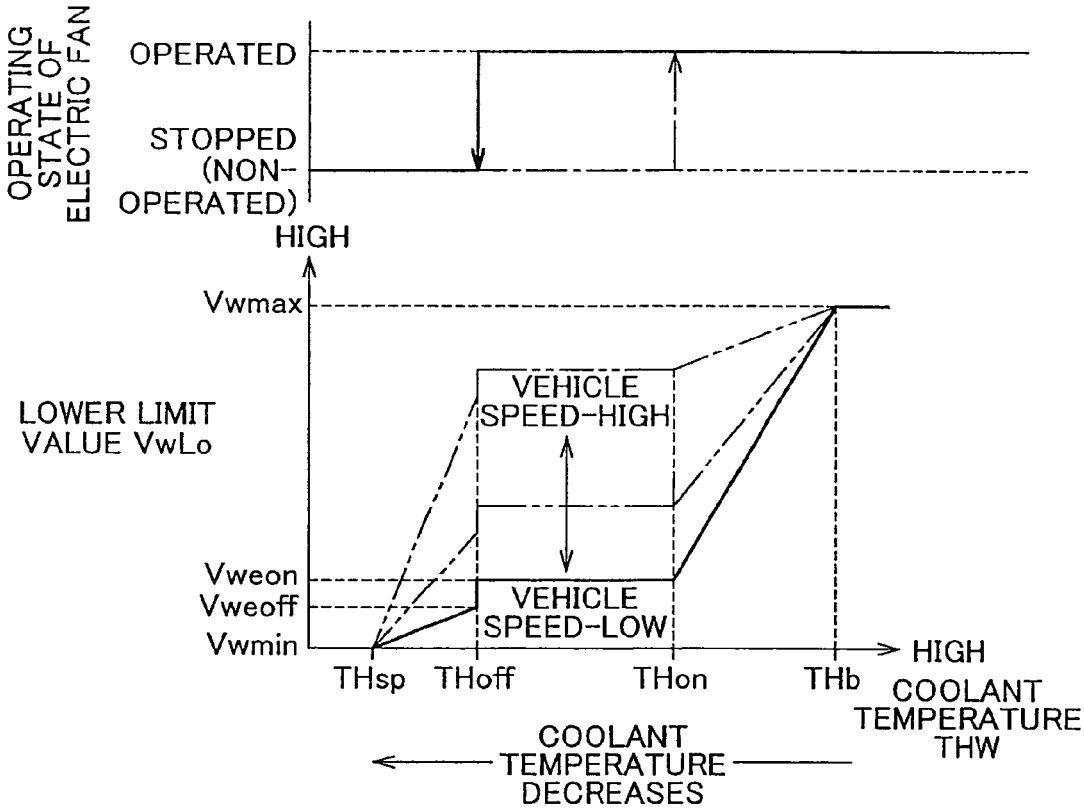
FIG. 25 is a graph showing the manner in which the lower limit value is changed when the coolant temperature decreases, in the modified example of the second embodiment.
Figure 26:
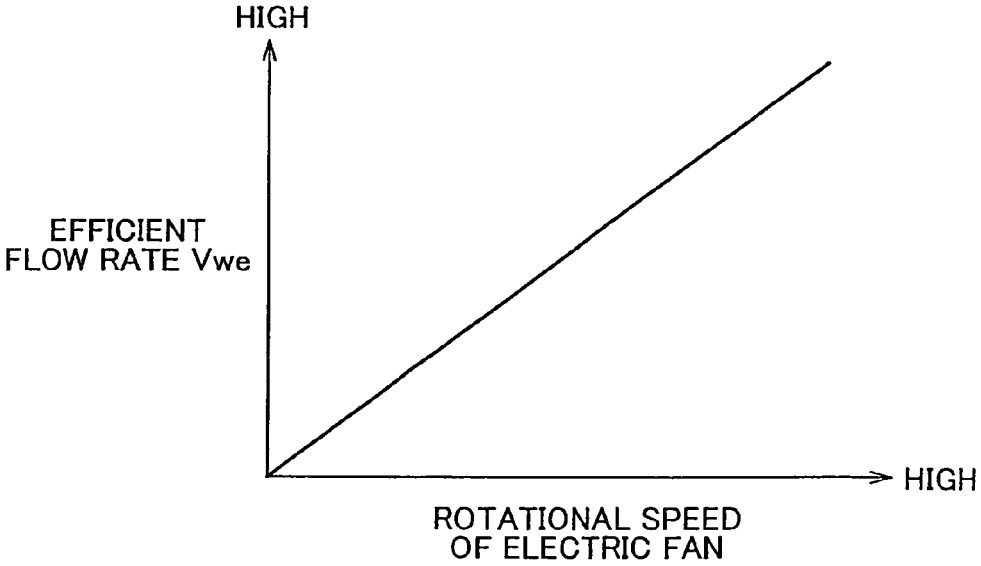
FIG. 26 is a graph showing a relation between the rotational speed of the electric fan and the efficient flow rate, in the modified example of the second embodiment.

FIG. 24 and FIG. 25 show the specific manner in which the lower limit value map is set. First, when the coolant temperature THW increases, the lower limit value VwLo is variably set in the manner shown in FIG. 24. That is, when the coolant temperature THW is equal to the vehicle speed-based correction start temperature THsp, the lower limit value VwLo is set to the minimum discharge flow rate Vwmin of the electric water pump 21. When the coolant temperature THW increases after the coolant temperature THW reaches the vehicle speed-based correction start temperature THsp, the lower limit value VwLo is increased in accordance with the increase in the coolant temperature THW so that the lower limit value VwLo is set to the non-operated time efficient flow rate Vweoff at the time point at which the coolant temperature THW reaches the fan stop temperature THoff. When the coolant temperature THW is between the fan stop temperature THoff and the fan operation temperature THon, the lower limit value VwLo is maintained at the non-operated time efficient flow rate Vweoff. When the coolant temperature THW reaches the fan operation temperature THon, the lower limit value VwLo is set to the operated time efficient flow rate Vweon that is higher than the non-operated time efficient flow rate Vweoff. When the coolant temperature THW increases after the coolant temperature THW reaches the fan operation temperature THon, the lower limit value VwLo is increased in accordance with the increase in the coolant temperature THW so that the lower limit value VwLo is set to the maximum discharge flow rate Vwmax of the electric water pump 21 at the time point at which the coolant temperature THW reaches the maximum required radiation temperature THb. After the coolant temperature THW reaches the maximum required radiation temperature THb, the lower limit value VwLo is set to the maximum discharge flow rate Vwmax of the electric water pump 21.

When the coolant temperature THW decreases, the lower limit value VwLo is variably set in the manner shown in FIG. 25. That is, when the coolant temperature THW is equal to or higher than the maximum required radiation temperature THb, the lower limit value VwLo is set to the maximum discharge flow rate Vwmax of the electric water pump 21. When the coolant temperature THW decreases from the maximum required radiation temperature THb, the lower limit value VwLo is decreased in accordance with the decrease in the coolant temperature THW so that the lower limit value VwLo is set to the operated time efficient flow rate Vweon at the time point at which the coolant temperature THW reaches the fan operation temperature THon. When the coolant temperature THW is between the fan operation temperature THon and the fan stop temperature THoff, the lower limit value VwLo is maintained at the operated time efficient flow rate Vweon. When the coolant temperature THW reaches the fan stop temperature THoff, the lower limit value VwLo is set to the non-operated time efficient flow rate Vweoff that is lower than the operated time efficient flow rate Vweon. When the coolant temperature THW decreases from the fan stop temperature THoff, the lower limit value VwLo is decreased in accordance with the decrease in the coolant temperature THW so that the lower limit value VwLo is set to the minimum discharge flow rate Vwmin of the electric water pump 21 at the time point at which the coolant temperature THW reaches the vehicle speed-based correction start temperature THsp. When the coolant temperature THW decreases from the vehicle speed-based correction start temperature THsp, the setting of the lower limit value VwLo is stopped.

By setting the lower limit value VwLo in this manner, the discharge flow rate Vw, which is corrected based on the vehicle speed, is increased when the electric fan 27 is operated, as compared to when the electric fan 27 is not operated.

In each of FIG. 24 and FIG. 25, the solid line shows the manner in which the lower limit value VwLo changes when the vehicle speed SP is a certain value. As shown by the two-dot chain line in each of FIG. 24 and FIG. 25, the lower limit value VwLo increases as the vehicle speed SP increases, as in the second embodiment. This modified example may be implemented in the third and fourth embodiments as well as in the second embodiment, according to the same principle.

In the case where the rotational speed of the electric fan 27 is variably set when the electric fan 27 is operated, as the rotational speed of the electric fan 27 increases, the amount of air passing through, the radiator 20 increases, and the level of the radiation performance of the radiator 20 increases. Accordingly, in the second embodiment, the discharge flow rate Vw is corrected based on the vehicle speed SP. However, the discharge flow rate Vw, which is corrected based on the vehicle speed SP, may be further corrected based on the rotational speed of the electric fan 27. More specifically, because the efficient flow rate Vwe increases as the rotational speed of the electric fan 27 increases, the discharge flow rate Vw, which is corrected based on the vehicle speed SP, may be increased as the rotational speed of the electric fan 27 increases. In this case as well, the discharge flow rate Vw of the electric water pump 21 is changed according to the level of the radiation performance of the radiator 20, which is changed according to the rotational speed of the electric fan 27, as well as according to the vehicle speed SP. This further increases the cooling efficiency. Accordingly, it is possible to further increase the level of the cooling performance, while effectively using the electric power supplied to the electric water pump 21.

Because the level of the cooling performance is increased in the above-described manner, the decrease in the coolant temperature THW is promoted to a larger extent as the rotational speed of the electric fan 27 increases. Therefore, the rotational speed of the electric fan 27 is more quickly decreased. This suppresses the increase in the electric power consumed by operating the electric fan 27.

By changing the electric power supplied to the electric motor that operates the electric fan 27, the rotational speed of the electric fan 27 is changed. Therefore, when the discharge flow rate Vw is corrected according to the rotational speed of the electric fan 27, for example, the discharge flow rate Vw may be corrected based on the voltage or the electric current supplied to the electric motor, or based on the duty ratio or the like when the rotational speed of the electric fan 27 is changed through the duty control. Also, the rotational speed of the electric fan 27 may be actually detected, and the discharge flow rate Vw may be corrected based on the detected rotational speed. This modified example may be also implemented in the third and fourth embodiments as well as in the second embodiment, according to the same principle.

In each of the above-described embodiments and the modified examples, when the discharge flow rate Vw is corrected, the lower limit value VwLo is set. In addition, the target flow rate Vwp may be directly corrected using a correction value that is set based on the coolant temperature THW, the vehicle speed SP, the operation time of the electric fan 27, the operating state of the electric fan 27, the rotational speed of the electric fan 27, or the like.

The invention claimed is:

1. A cooling apparatus for an internal combustion engine, comprising:

an electric water pump that circulates a coolant in a cooling pipe provided in an internal combustion engine;

a radiator that radiates heat of the coolant;

an electric fan that cools the radiator;

a control device that controls the electric water pump and the electric fan; and first flow rate correction portion, wherein:

the control device controls a discharge flow rate of the electric water pump based on a target flow rate set according to an amount of heat generated in the internal combustion engine, and controls operation of the electric fan based on a temperature of the coolant;

the first flow rate correction portion sets a lower limit value of the discharge flow rate based on the temperature of the coolant; and the first flow rate correction portion increases the lower limit value of the discharge flow rate in accordance with an increase in the temperature of the coolant, when the temperature of the coolant is equal to or higher than an operation temperature at which the operation of the electric fan is started.

2. The cooling apparatus according to claim 1, further comprising:

second flow rate correction portion that corrects the lower limit value of the discharge flow rate of the electric water pump based on a vehicle speed.

3. The cooling apparatus according to claim 2, wherein the second flow rate correction portion increases the lower limit value of the discharge flow rate as the vehicle speed increases.

4. The cooling apparatus according to claim 2, wherein when the electric fan is operated, the second flow rate correction portion increases the lower limit value of the discharge flow rate corrected based on the vehicle speed, as compared to when the electric fan is not operated.

5. The cooling apparatus according to claim 2, wherein:

the control device variably controls a rotational speed of the electric fan; and the second flow rate correction portion further corrects the lower limit value of the discharge flow rate corrected based on the vehicle speed, according to a rotational speed of the electric fan.

6. The cooling apparatus according to claim 5, wherein the second flow rate correction portion increases the lower limit value of the discharge flow rate as the rotational speed of the electric fan increases.

7. The cooling apparatus according to claim 2, wherein the second flow rate correction portion corrects the lower limit value of the discharge flow rate based on the vehicle speed, when the temperature of the coolant is between a stop temperature at which the operation of the electric fan is stopped, and the operation temperature that is higher than the stop temperature.

8. The cooling apparatus according to claim 7, wherein:

when the temperature of the coolant increases from a temperature in a temperature range below the stop temperature, the first flow rate correction portion increases the lower limit value of the discharge flow rate in accordance with the increase in the temperature of the coolant so that the lower limit value is equal to the lower limit value corrected based on the vehicle speed, at a time point at which the temperature of the coolant reaches the stop temperature; and when the temperature of the coolant increases in a temperature range above the operation temperature, the first flow rate correction portion increases the lower limit value corrected based on the vehicle speed, in accordance with the increase in the temperature of the coolant.

9. The cooling apparatus according to claim 2, wherein:

when the target flow rate is equal to or lower than the lower limit value, the second flow rate correction portion sets the target flow rate to the lower limit value.

10. The cooling apparatus according to claim 2, wherein:

the control device controls the operation of the electric fan according to the temperature of the coolant and according to a parameter different from the temperature of the coolant;

the second flow rate correction portion starts to correct the lower limit value of the discharge flow rate when the temperature of the coolant reaches a predetermined value; and when the electric fan is operated according to a request for operating the electric fan based on the parameter different from the temperature of the coolant, the control device executes a predetermined value change control that increases the predetermined value as compared to when there is no request for driving the electric fan based on the parameter different from the temperature of the coolant.

11. The cooling apparatus according to claim 2, wherein:

the control device variably controls a rotational speed of the electric fan;

the second flow rate correction portion starts to correct the lower limit value of the discharge flow rate when the temperature of the coolant reaches a predetermined value;

when the electric fan is operated according to a request for operating the electric fan based on a parameter different from the temperature of the coolant, and the rotational speed is higher than a preset value, the control device executes a predetermined value change control that increases the predetermined value; and when the electric fan is operated according to the request for operating the electric fan based on the parameter different from the temperature of the coolant, and the rotational speed is equal to or lower than the preset value, the control device does not execute the predetermined value change control.

12. The cooling apparatus according to claim 1, wherein:

when the target flow rate is equal to or lower than the lower limit value, the first flow rate correction portion sets the target flow rate to the lower limit value.

13. The cooling apparatus according to claim 1, further comprising third flow rate correction portion that corrects the lower limit value of the discharge flow rate of the electric water pump based on an elapsed time after the operation of the electric fan is started.

14. The cooling apparatus according to claim 13, wherein the third flow rate correction portion increases the lower limit value of discharge flow rate as the elapsed time increases.

15. The cooling apparatus according to claim 13, wherein:

when the target flow rate is equal to or lower than the lower limit value, the third flow rate correction portion sets the target flow rate to the lower limit value.

16. A cooling method for an internal combustion engine, in which the internal combustion engine is cooled by circulating a coolant in a cooling pipe provided for the internal combustion engine, radiating heat of the coolant using a radiator, and cooling the radiator using an electric fan, the cooling method comprising:

setting a target flow rate of the coolant according to an amount of heat generated in the internal combustion engine;

setting a lower limit value of a discharge flow rate of the coolant based on a temperature of the coolant, when the temperature of the coolant is equal to or higher than an operation temperature at which operation of the electric fan is started;

controlling the discharge flow rate of the coolant based on the lower limit value, when the target flow rate is equal to or lower than the lower limit value; and controlling the discharge flow rate of the coolant based on the target flow rate, when the target flow rate is higher than the lower limit value.

17. The cooling method according to claim 16, further comprising:

setting a first lower limit value of the discharge flow rate of the coolant based on the temperature of the coolant and a vehicle speed, when the temperature of the coolant is equal to or higher than a first predetermined value that is lower than the operation temperature;

controlling the discharge flow rate of the coolant based on the first lower limit value, when the target flow rate is equal to or lower than the first lower limit value; and controlling the discharge flow rate of the coolant based on the target flow rate, when the target flow rate is higher than the first lower limit value.

18. The cooling method according to claim 16, further comprising:

setting a second lower limit value of the discharge flow rate of the coolant based on the temperature of the coolant and a vehicle speed, when the electric fan is operated according to a request for operating the electric fan based on a parameter different from the temperature of the coolant, and the temperature of the coolant is equal to or higher than a second predetermined value that is higher than a first predetermined value and lower than the operation temperature;

controlling the discharge flow rate of the coolant based on the second lower limit value, when the target flow rate is equal to or lower than the second lower limit value; and controlling the discharge flow rate of the coolant based on the target flow rate, when the target flow rate is higher than the second lower limit value.

19. The cooling method according to claim 16, further comprising:

setting a first lower limit value of the discharge flow rate of the coolant based on the temperature of the coolant and a vehicle speed, when the electric fan is operated at a rotational speed equal to or lower than a preset value according to a request for operating the electric fan based on a parameter different from the temperature of the coolant, and the temperature of the coolant is equal to or higher than a first predetermined value that is lower than the operation temperature;

controlling the discharge flow rate of the coolant based on the first lower limit value, when the target flow rate is equal to or lower than the first lower limit value;

controlling the discharge flow rate of the coolant based on the target flow rate, when the target flow rate is higher than the first lower limit value;

setting a second lower limit value of the discharge flow rate of the coolant based on the temperature of the coolant and the vehicle speed, when the electric fan is operated at a rotational speed higher than the preset value according to the request for operating the electric fan based on the parameter different from the temperature of the coolant, and the temperature of the coolant is equal to or higher than a second predetermined value that is higher than the first predetermined value and lower than the operation temperature;

controlling the discharge flow rate of the coolant based on the second lower limit value, when the target flow rate is equal to or lower than the second lower limit value; and controlling the discharge flow rate of the coolant based on the target flow rate, when the target flow rate is higher than the second lower limit value.

* * * * *